US007395866B2

(12) United States Patent
Milberger et al.

(10) Patent No.: US 7,395,866 B2
(45) Date of Patent: Jul. 8, 2008

(54) METHOD AND APPARATUS FOR BLOW-OUT PREVENTION IN SUBSEA DRILLING/COMPLETION SYSTEMS

(75) Inventors: Lionel J. Milberger, Wheelock, TX (US); Larry E. Reimert, Houston, TX (US); Morris B. Wade, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 347 days.

(21) Appl. No.: 10/527,541

(22) PCT Filed: Sep. 15, 2003

(86) PCT No.: PCT/US03/29013

§ 371 (c)(1),
(2), (4) Date: Mar. 11, 2005

(87) PCT Pub. No.: WO2004/025069

PCT Pub. Date: Mar. 25, 2004

(65) Prior Publication Data

US 2005/0269096 A1 Dec. 8, 2005

Related U.S. Application Data

(60) Provisional application No. 60/410,394, filed on Sep. 13, 2002.

(51) Int. Cl.
*E21B 29/12* (2006.01)

(52) U.S. Cl. ..... 166/345; 166/85.4; 166/88.4

(58) Field of Classification Search ..... 166/85.4, 166/88.4, 368, 367, 338, 345, 378
See application file for complete search history.

(56) References Cited

U.S. PATENT DOCUMENTS

| | | | | | |
|---|---|---|---|---|---|
| 3,741,294 | A | * | 6/1973 | Morrill | 166/367 |
| 4,325,434 | A | * | 4/1982 | Roberts | 166/321 |
| 4,491,176 | A | * | 1/1985 | Reed | 166/66.4 |
| 4,552,213 | A | * | 11/1985 | Boyd et al. | 166/88.4 |
| 4,623,020 | A | * | 11/1986 | Nichols | 166/88.4 |
| 4,796,704 | A | * | 1/1989 | Forrest et al. | 166/317 |
| 4,901,803 | A | * | 2/1990 | Levier | 175/5 |
| 5,335,727 | A | * | 8/1994 | Cornette et al. | 166/278 |

(Continued)

*Primary Examiner*—Thomas A Beach
(74) *Attorney, Agent, or Firm*—Browning Bushman P.C.

(57) ABSTRACT

A system and method for subsea drilling/completion. The system comprises a high-pressure riser extending from a semi-submersible platform to a subsea wellhead. A landing string extends along the insider of the riser, and has a surface blowout preventer and at least one subsea blowout preventer attached thereto. A tubing hanger running tool is run from the platform toward the wellhead. In one embodiment, hydraulic control for various functions of the tubing hanger running tool is communicated either through the tubing string or through the riser. In another embodiment, hydraulic control lines for the tubing hanger running tool extend from the platform to the tubing hanger running tool through an umbilical line, which may either run through the tubing string, inside the riser but outside the tubing string, or outside and alongside the riser. In an embodiment where the umbilical line runs inside the riser, a protective structure is provided to prevent damage to the umbilical line in the event that the subsea blowout preventer is deployed.

29 Claims, 26 Drawing Sheets

U.S. PATENT DOCUMENTS 5,439,060 A * 8/1995 Huete et al. ..... 166/367
5,727,640 A * 3/1998 Gleditsch ..... 175/7
5,848,656 A * 12/1998 Møksvold ..... 175/7
5,992,527 A * 11/1999 Garnham et al. ..... 166/379
6,109,352 A * 8/2000 Edwards et al. ..... 166/336
6,170,578 B1 * 1/2001 Edwards et al. ..... 166/339
6,302,212 B1 * 10/2001 Nobileau ..... 166/368
6,367,553 B1 * 4/2002 Boyd ..... 166/360
6,470,971 B1 * 10/2002 Bridges ..... 166/379
6,516,876 B1 * 2/2003 Jennings ..... 166/77.51
6,637,514 B1 * 10/2003 Donald et al. ..... 166/368
6,675,900 B2 * 1/2004 Baskett et al. ..... 166/379
7,062,960 B2 * 6/2006 Couren et al. ..... 73/152.51
7,111,687 B2 * 9/2006 Donald et al. ..... 166/368
7,114,571 B2 * 10/2006 Gatherar et al. ..... 166/367

* cited by examiner

METHOD AND APPARATUS FOR BLOW-OUT PREVENTION IN SUBSEA DRILLING/COMPLETION SYSTEMS

PRIORITY DATA

Pursuant to 35 U.S.C. § 119, this application claims the priority of prior provisional U.S. patent application Ser. No. 60/410,394 filed on Sep. 13, 2002, which provisional application is hereby incorporated by reference herein in its entirety.

FIELD OF THE INVENTION

This invention relates generally to the field of subsea oil and gas wells, and more particularly relates to blow-out prevention in completion of subsea oil and gas wells.

BACKGROUND OF THE INVENTION

Subsea wells are frequently drilled using a floating drilling vessel such as a semi-submersible vessel using a subsea blow-out preventer (BOP) stack mounted on the wellhead near the sea bed. Commonly, if a subsea tree is then installed, a subsea BOP is also used to run the tubing hanger.

Certain operators, in order to save cost, have come to drill subsea wells using a floater with a surface-type BOP located at the rig. A high pressure riser extends from the surface-type BOP stack to the subsea wellhead. This type equipment is satisfactory for drilling the well, but, can present a problem during completion of the well. In particular, when a tubing hanger is run with a tubing hanger running tool (THRT), the umbilical which provides control for the tool can be damaged or cut if the surface BOP is closed for any reason, e.g., to control the well in case of a kick or to close the rams to pressure test the tubing hanger after it is landed.

Because of safety concerns, a refinement to the surface stack drilling technique has been made in recent years wherein a simplified subsea stack is incorporated just above the wellhead. Normally, the set of rams in the subsea stack has only emergency control and is not routinely used for pressure control.

SUMMARY OF THE INVENTION

The present invention involves an improved method and apparatus for completing subsea wells when a floating drilling rig (outfitted with a surface-type BOP) is used for running the tubing hanger. In accordance with one aspect of the invention, several methods and paths for the umbilical may be used when running and controlling the THRT. BOP operation must be available when running the THRT and the present invention ensures that the umbilical will not be damaged or cut when the THRT is run.

In one embodiment, a tubing hanger is run with a THRT that is run, landed, and tested through a riser, wherein control for the operation of the THRT is achieved by hydraulic pressure through the inside of the landing string. Preferably, the riser contains a surface-type BOP and possibly a subsea BOP.

In another embodiment, a tubing hanger is run with a THRT which is run, landed, and tested through a riser, wherein control for the operation of the THRT is achieved by hydraulic pressure through the outside of the landing string and inside the riser. Preferably, the riser contains a surface-type BOP and possibly a subsea BOP.

In still another embodiment, a tubing hanger is run with a THRT which is run, landed, and tested through a riser that contains a surface-type BOP, wherein control for the operation of the THRT is achieved by hydraulic pressure through an umbilical in the annulus alongside the landing string and inside the riser. Preferably, the riser contains a surface-type BOP and possibly a subsea BOP. The landing string also preferably contains protective means for protecting the umbilical when the BOP is closed around said landing string.

In still another embodiment of the invention, a hanger is run with a THRT that is run, landed, and tested through a riser, wherein control for the operation of the THRT is achieved by hydraulic pressure through an umbilical run alongside the outside of the riser. Preferably, the riser contains a surface-type BOP and possibly a subsea BOP.

In yet another embodiment of the invention, a tubing hanger is run with a THRT that is run, landed, and tested through a riser, wherein control for the operation of the THRT is achieved by hydraulic pressure through an umbilical which is run inside the landing string. Preferably, the riser contains a surface-type BOP and possibly a subsea BOP.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION OF SPECIFIC EMBODIMENTS OF THE INVENTION

In the disclosure that follows, in the interest of clarity, not all features of actual implementations are described. It will of course be appreciated that in the development of any such actual implementation, as in any such project, numerous engineering and programming decisions must be made to achieve the developers' specific goals and subgoals (e.g., compliance with system and technical constraints), which will vary from one implementation to another. Moreover, attention will necessarily be paid to proper engineering practices for the environment in question. It will be appreciated that such a development effort might be complex and time-consuming, but would nevertheless be a routine undertaking for those of ordinary skill in the relevant fields.

Furthermore, for the purposes of the present disclosure, the terms "comprise" and "comprising" shall be interpreted in an inclusive, non-limiting sense, recognizing that an element or method step said to "comprise" one or more specific components may include additional components.

Those of ordinary skill in the art will appreciate that the prior art is replete with examples of subsea drilling/completion systems implemented in various wellknown ways. It is believed that those of ordinary skill in the art having the benefit of the present disclosure will readily appreciate how the present invention may be practiced in conjunction with various different implementations of subsea drilling/completion systems; that is, the present invention is not limited to practice with one particular type of drilling system. Consequently, in the interests of clarity, only those components of a subsea drilling/completion system of relevance to the present invention are described below.

Figure 1:
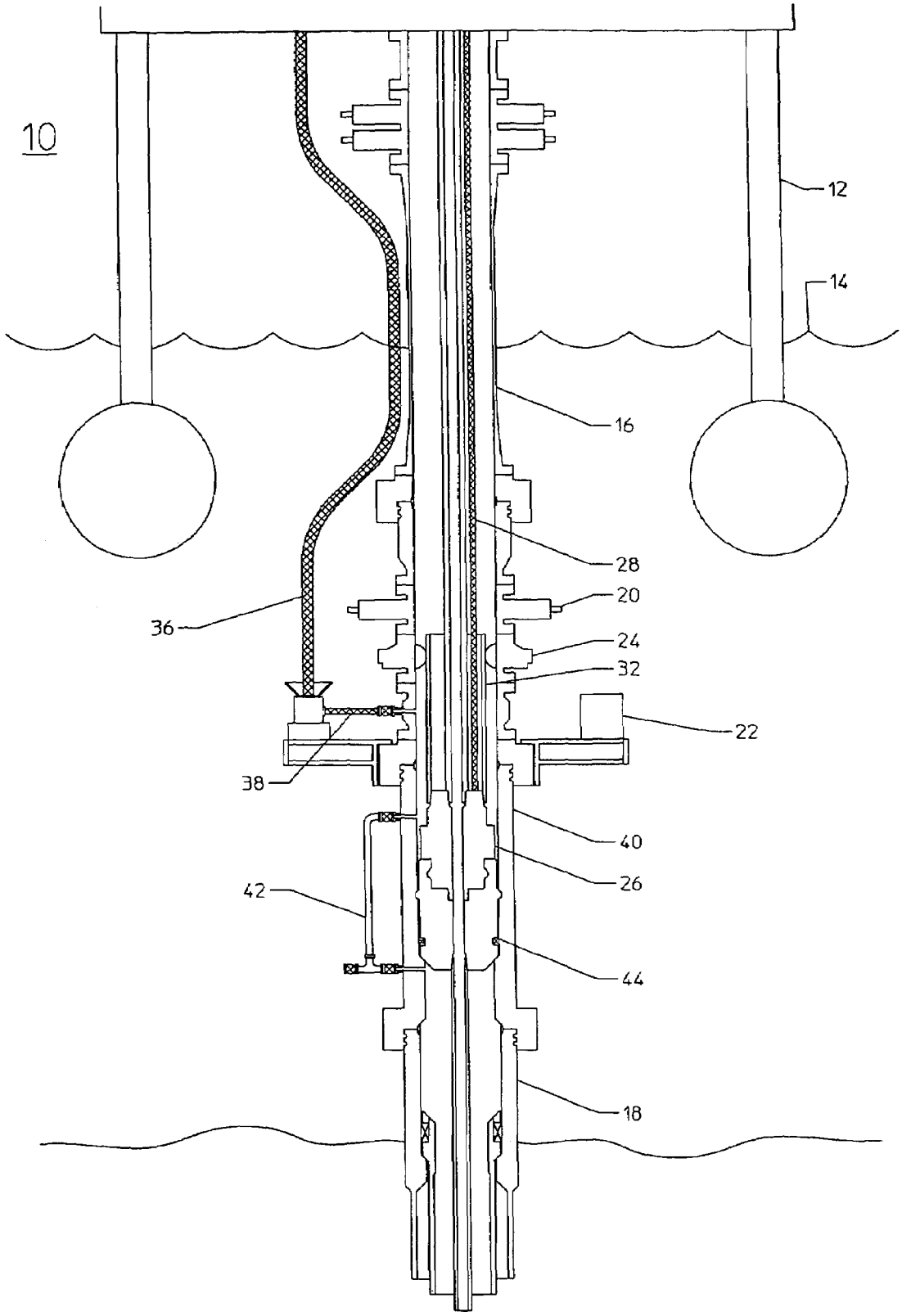
FIG. 1 is side cross-sectional view of a subsea drilling/completion system in accordance with one of several embodiments of the invention.

Referring to FIG. 1, there is shown a subsea drilling/completion system 10 in accordance with one embodiment of the invention. System 10 includes a semi-submersible platform 12 floating partially above and partially below the water surface 14. A riser 16 extends from platform 12 downward toward a subsea wellhead 18.

In the embodiment of FIG. 1, blowout prevention, pressure control, and other functions are achieved by use of a subsea emergency BOP 20. The blowout preventer 20 is convention in having injectable seals, pipe rams, fluid rams, shear rams, and/or other related mechanisms used to prevent undesired release of well fluids and to effect measurement and control operations employed in the drilling and completion of a well. Blowout preventers are well-known in the art, and it is believed that the details of the implementation of the various blowout preventers mentioned in this disclosure need not be provided herein in order for those of ordinary skill in the art to appreciate and practice the present invention.

A control pod 22 is disposed on the lower end of riser 16. Preferably, an annular BOP 24 is also mounted below the emergency BOP for pressure control during the completion phase, i.e., when running the tubing hanger running tool (THRT), designated with reference numeral 26 in FIG. 1. As can be seen in FIG. 1, an umbilical 28 for the THRT is run inside riser 16 and outside and alongside the landing string 30. The umbilical provides fluid lines, control lines, and/or data lines between platform 12 and the subsea wellhead 18. Umbilical protection is provided by a protective sleeve 32 which is mounted to and sealed to the THRT. Sleeve 32 provides protection of umbilical 28 when annular BOP 24 is closed.

With continued reference to FIG. 1, annulus circulation is achieved by an external hose 36 run alongside and outside riser 16. An annulus line 38 enters riser 16 below annular BOP 24 and above the tubing head 40. Annulus circulation is further facilitated by an annulus circulation line 42 which exits the tree above tubing hanger 44 and reenters below tubing hanger 44.

Alternatively, annulus circulation can be achieved from above tubing hanger 44 to below tubing hanger 44, where the path is a bore (not shown in FIG. 1) within tree head 40 and includes a valve mounted within the tubing head.

It is contemplated that external umbilical line 36 may also include hydraulic power and control lines for subsea BOP20 and/or annular BOP 24.

Figure 2:
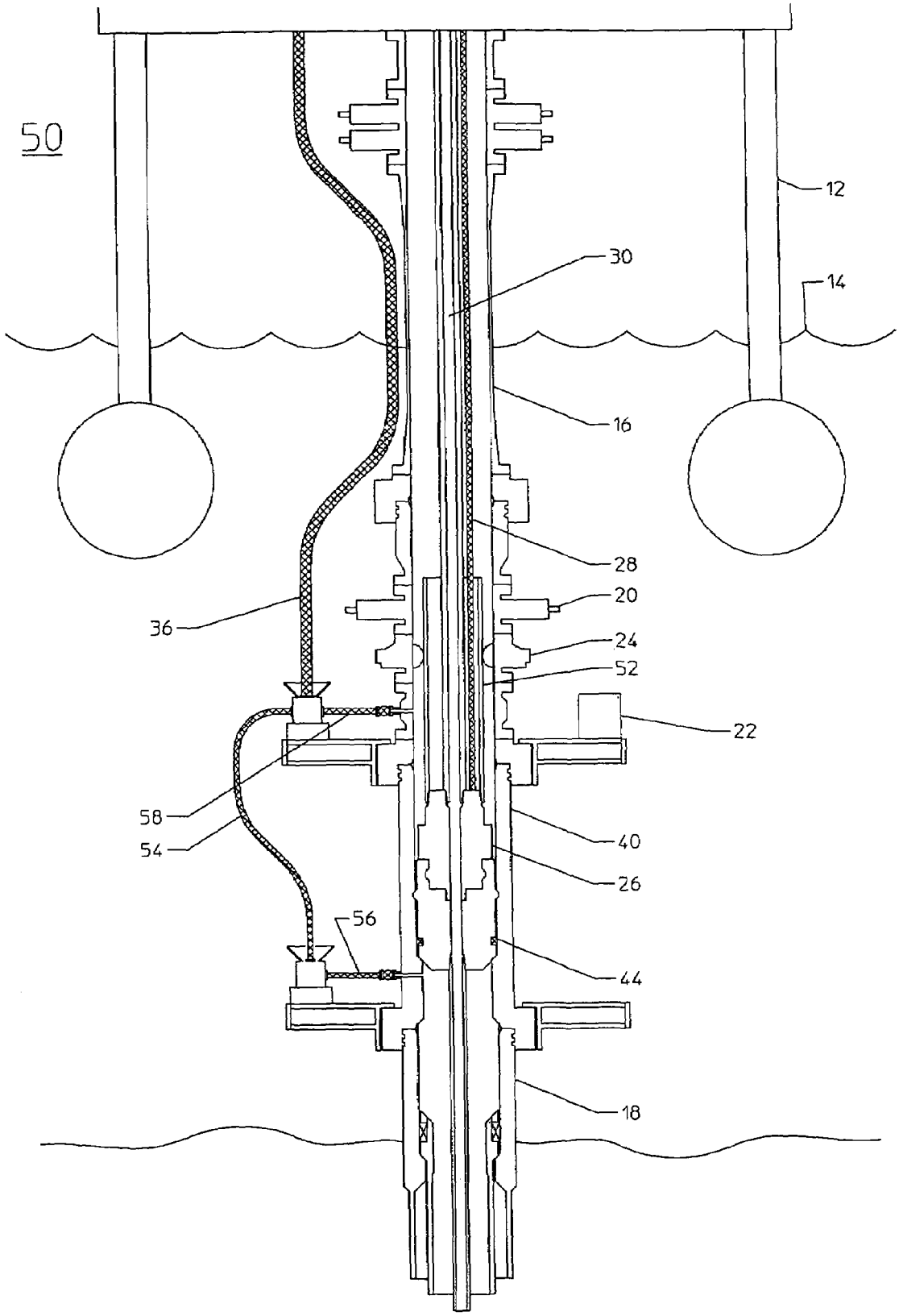
FIG. 2 is a side cross-sectional view of a subsea drilling/completion system in accordance with one of several alternative embodiments of the invention.

Turning now to FIG. 2, there is shown a subsea drilling/completion system 50 in accordance with an alternative embodiment of the invention. (In the present disclosure, various embodiments are disclosed which incorporate many of the same components; in such cases, elements which are essentially identical in two or more embodiments shall be identified with the same reference numerals in the two or more Figures depicting those embodiments.)

In the embodiment of FIG. 2, BOP protection is also achieved by use of subsea emergency BOP 20, and involves the use of control pod 22 on the lower end of riser 16. Preferably, annular BOP 24 is also mounted below emergency BOP 20 for pressure control during the completion phase. Control umbilical 28 for THRT 26 is run inside riser 16 and outside and alongside landing string 30. Umbilical protection is achieved by a protective sleeve 52 which is mounted to and sealed to THRT 26, providing, protection when annular BOP 24 is closed.

In the embodiment of FIG. 2, annulus circulation is achieved by external umbilical line 36 running alongside and outside riser 16 and terminates in a stab on the BOP base. Annulus circulation is further achieved via a jumper 54 and a circulation line 56 to the base of tubing head 40 and then enters tubing head 40 below tubing hanger 44. External umbilical line 36 may also include hydraulic power and control lines for the subsea BOP. Pressure testing on top of the tubing hanger is achieved by closing the annular BOP and then pressuring down a pressure test line 58 in external umbilical 36.

Figure 3:
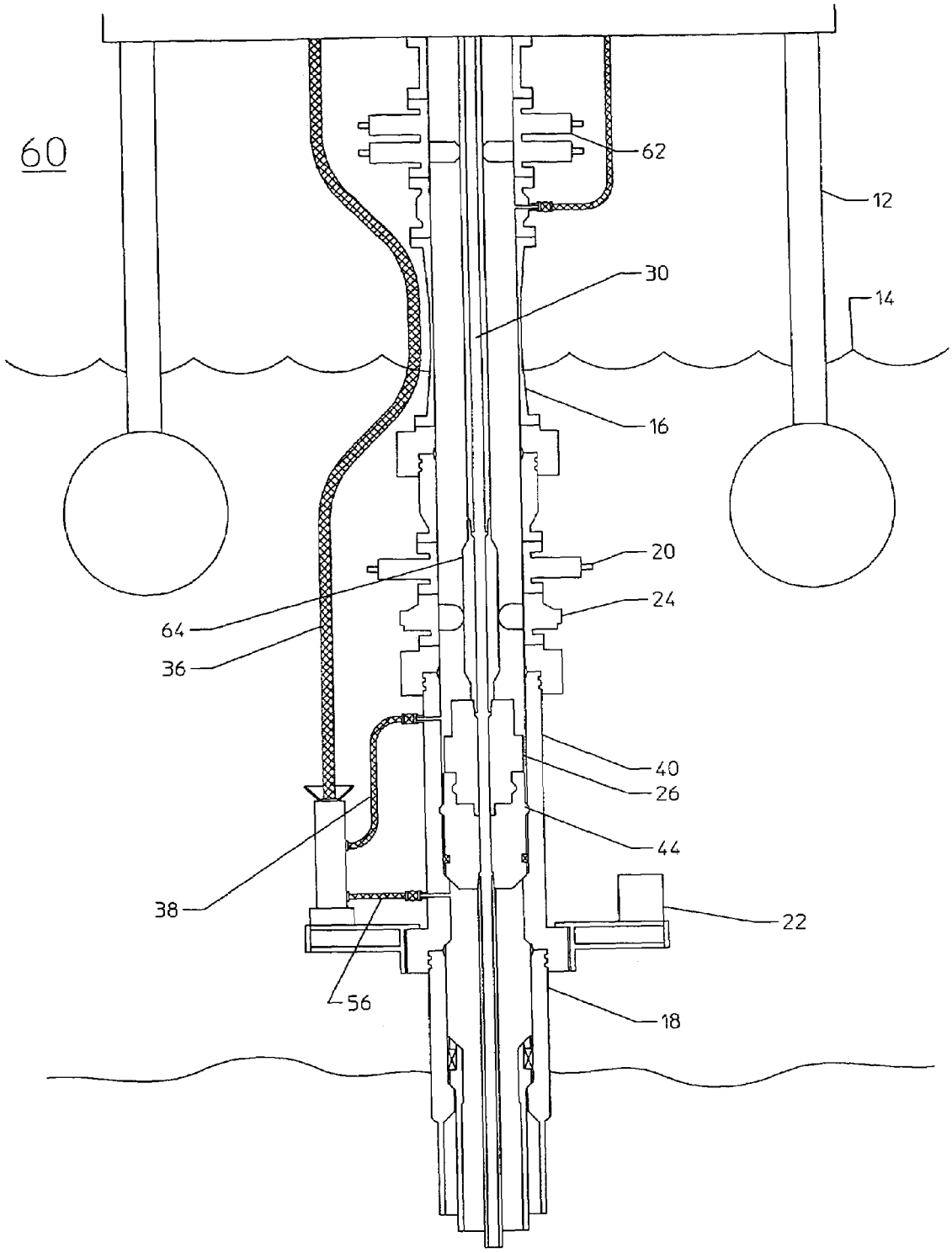
FIG. 3 is a side cross-sectional view of a subsea drilling/completion system in accordance with one of several alternative embodiments of the invention.

Turning now to FIG. 3, there is shown a subsea drilling/completion system 60 in accordance with still another embodiment of the invention. In system 60 of FIG. 3, BOP functions are achieved by use of a surface BOP 62. Annular BOP 24 may be located subsea below emergency BOP 20. Control pod 22 is disposed on the lower end of riser 16. Annular BOP 24 is used for control functions as shall be described in further detail below.

In the embodiment of FIG. 3, control for THRT 26 is achieved by providing a switching valve assembly 64 in the landing string above THRT 26. Annular BOP 24 is closed around the landing string. With surface BOP 62 and the subsea annular BOP 24 both closed, pressure is introduced inside riser 16 below surface BOP 62 to perform a switching function on switching valve 64. After switching valve 64 has switched, pressure is introduced below annular BOP 24 to perform the preselected action on the THRT which has been determined by switching valve 64 (e.g., lock, unlock, latch, unlatch, or all block).

With continued reference to FIG. 3, umbilical protection is achieved by not having a control umbilical inside the riser 16. Annulus circulation is achieved by external hose 36 running alongside and outside of riser 16 and terminating in a stab on the base of tubing head 40. The annulus line then goes via jumper 56 to tubing head 40 and enters tubing head 40 below tubing hanger 44. External umbilical line 36 might also include hydraulic power and control lines for subsea BOP 20 and/or annular BOP 24.

Pressure testing on top of tubing hanger 44 is achieved by closing surface BOP 62, opening subsea BOP 20, closing appropriate valves and then pressuring down umbilical line 38 to pressurize inside riser 16 below surface BOP 62.

Figure 4:
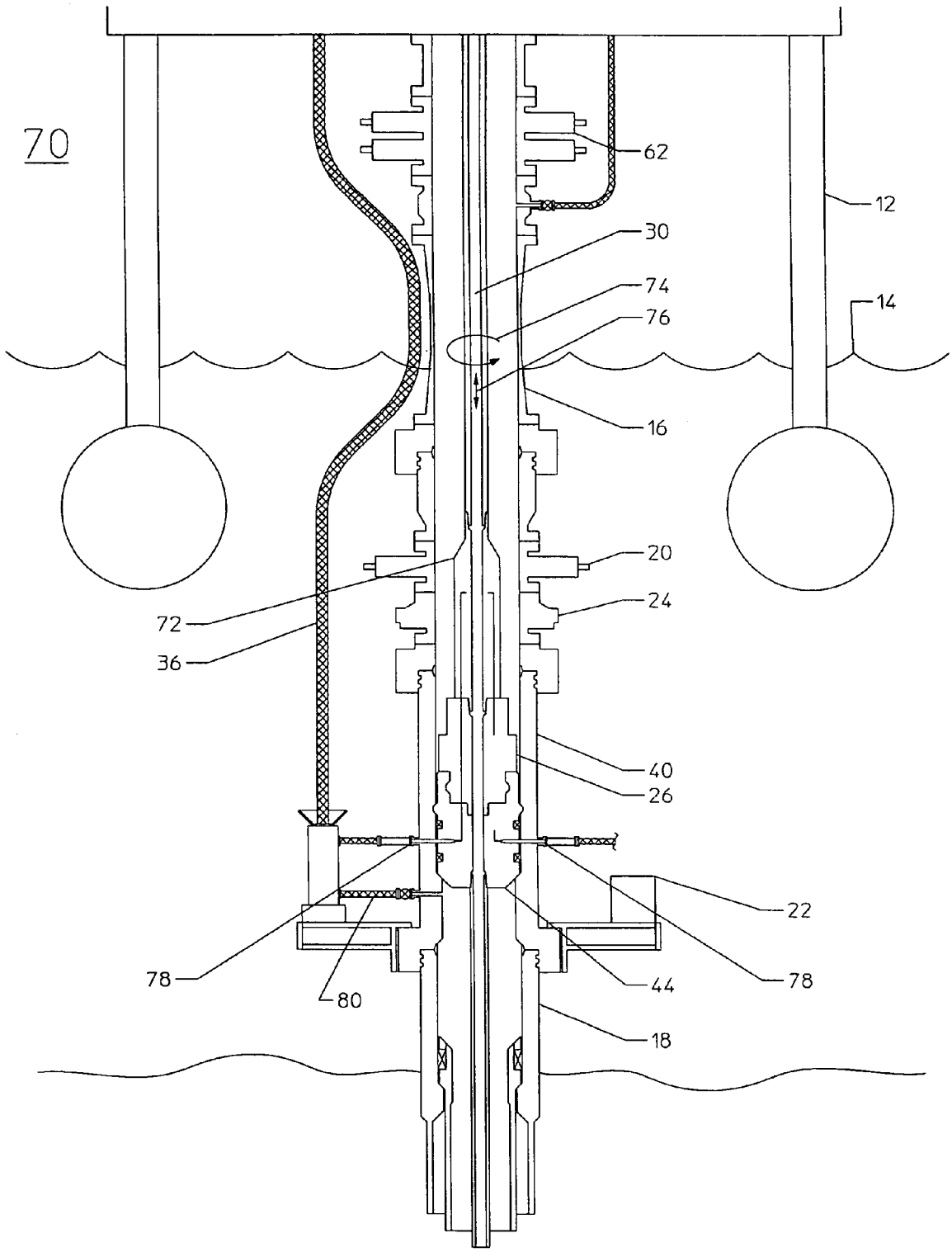
FIG. 4 is a side cross-sectional view of a subsea drilling/completion system in accordance with one of several alternative embodiments of the invention.

Turning now to FIG. 4, there is shown a subsea drilling/completion system 70 in accordance with yet another embodiment of the invention. In system 70, BOP operation is achieved by use of surface BOP 62. The control for THRT 26 is achieved by providing a switching valve assembly 72 is included in the landing string above THRT 26. Various positions on the switching valve can be selected by rotation or push-pull action on the landing string, as indicated by arrows 74 and 76 in FIG. 4. After switching valve 72 has switched, pressure is introduced through a hydraulic conduit in external umbilical 36 to radial penetrators 78 into tubing hanger 44 to perform the selected function. In the embodiment of FIG. 4, umbilical protection is achieved by not having a control umbilical inside riser 16.

With continued reference to FIG. 4, annulus circulation is achieved through umbilical line 36 running alongside and outside of riser 16 and terminating in a stab 80 on the base of tubing head 40 below the tubing hanger. External umbilical line 36 might also include a hydraulic power line.

Pressure test on top of tubing hanger 44 is achieved by closing surface BOP 62 and the pressuring down the pressure line to pressurize inside riser 16 below surface BOP 62.

Figure 5:
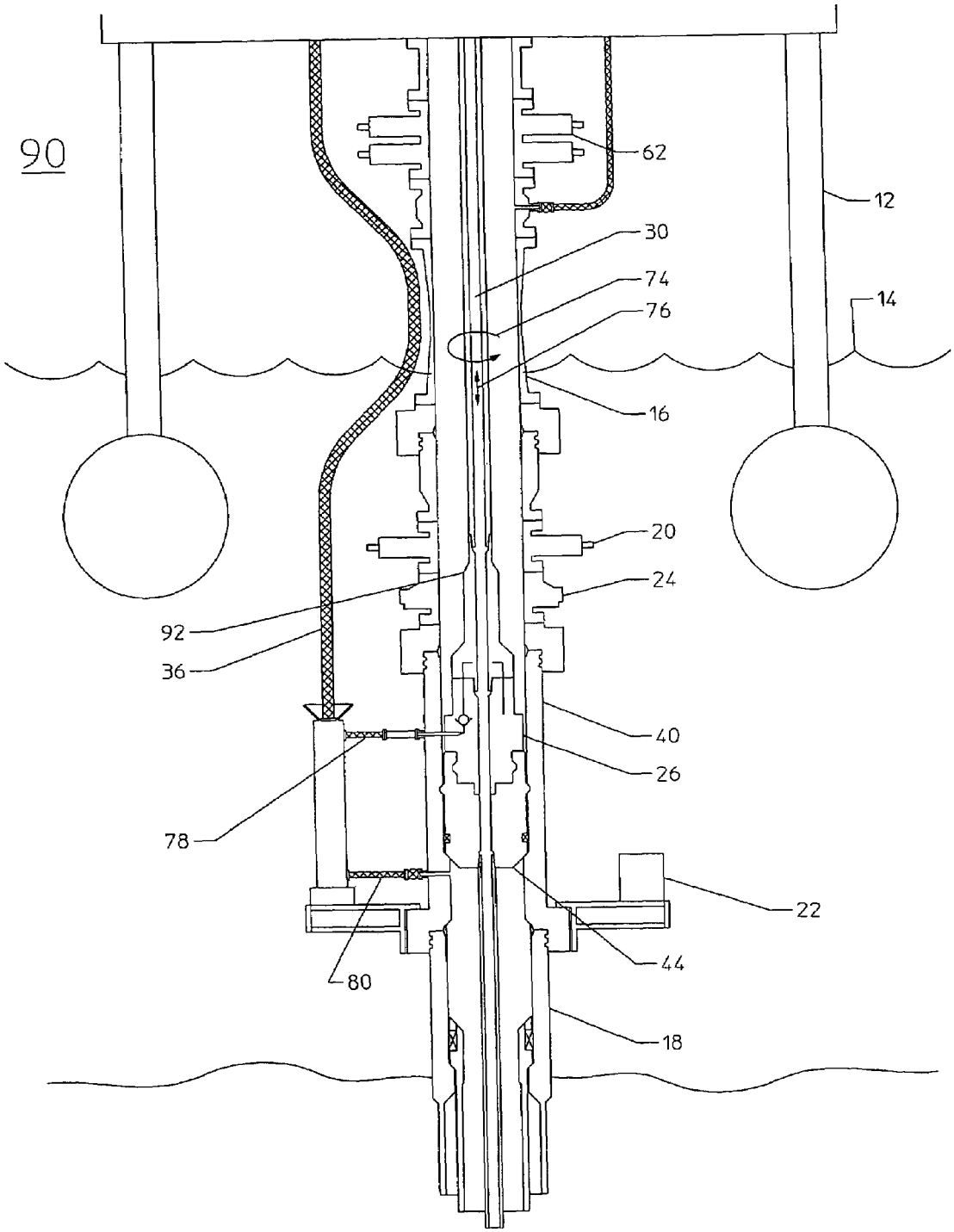
FIG. 5 is a side cross-sectional view of a subsea drilling/completion system in accordance with one of several alternative embodiments of the invention.

Turning now to FIG. 5, there is shown a subsea drilling/completion system 90 in accordance with still another embodiment of the invention. In the embodiment of FIG. 5, as with that of FIG. 4, BOP operation is achieved by use of surface BOP 62. Control for THRT 26 is by providing a switching valve assembly 92 is included in the landing string above THRT 26. Various positions on the switching valve (e.g., lock, unlock, latch, unlatch, all block) can be selected by rotation or push-pull action on the landing string, as indicated by arrows 74 and 76 in FIG. 5.

After the switching valve has switched, pressure is introduced through a hydraulic conduit in external umbilical 36 to a radial penetrator 78 into THRT 26 to perform the selected function.

Umbilical protection in the embodiment of FIG. 5 is achieved by not having a control umbilical inside riser 16.

Annulus circulation is achieved through umbilical line 36 running alongside and outside of riser 16 and terminating in a stab on the base of tubing head 40 and enters the tubing head below tubing hanger 44. External umbilical line 30 may also include a hydraulic power line.

Pressure test on top of tubing hanger is achieved by closing surface BOP 62, and pressuring down the pressure line to pressurize inside riser 16 below surface BOP 62.

Figure 6:
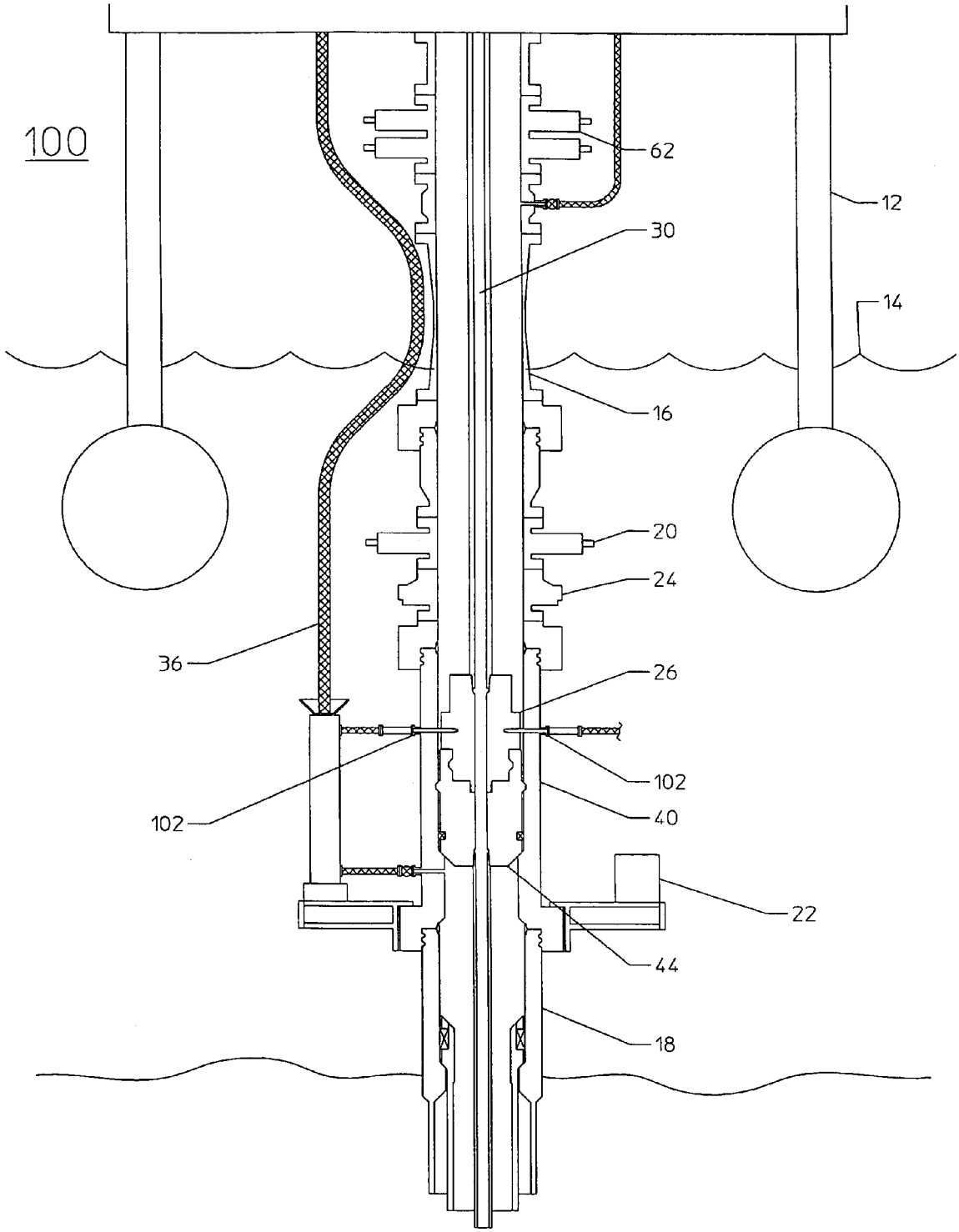
FIG. 6 is a side cross-sectional view of a subsea drilling/completion system in accordance with one of several alternative embodiments of the invention.

Turning now to FIG. 6, there is shown a subsea drilling/completion system 100 in accordance with still another embodiment of the present invention. In the embodiment of FIG. 6, BOP protection is achieved by use of surface BOP 62. Control for THRT 26 is achieved with multiple radial penetrators 102 are used to go from outside tubing head 40 to tubing hanger running tool 26. One of the lines 102 contains hydraulic power from the surface and is run along with external umbilical line 36 outside the riser.

Other radial penetrators (not shown) may be used to activate and/or select functions on the tubing hanger running tool. Umbilical protection is achieved by not having a control umbilical inside riser 16.

Annulus circulation is achieved in the embodiment of FIG. 6 through umbilical line 36 running alongside and outside riser 16 and terminating in stab on the base of tree head 40. The annulus line then goes via a jumper to the tubing head and enters tubing head 40 below tubing hanger 44. External umbilical line 36 may also include multiple hydraulic lines.

Pressure test on top of tubing hanger 44 is achieved by closing surface BOP 62, and then pressuring down the pressure line to pressurize inside riser 16 below surface BOP 62.

Figure 7:
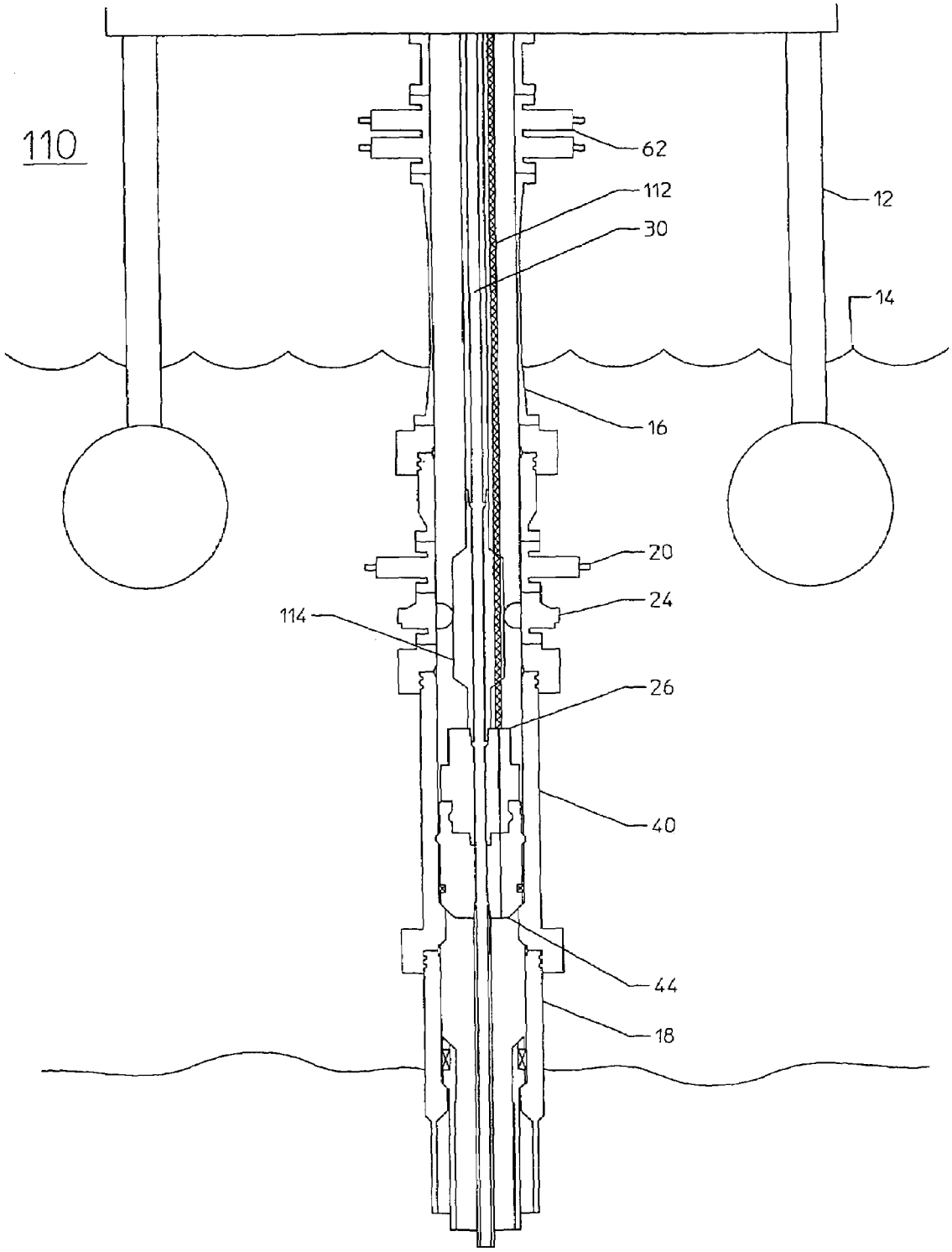
FIG. 7 is a side cross-sectional view of a subsea drilling/completion system in accordance with one of several alternative embodiments of the invention.

Turning now to FIG. 7, there is shown a subsea drilling/completion system 110 in accordance with still another embodiment of the invention. In the embodiment of FIG. 7, BOP prevention is achieved by use of subsea BOP 20, which is preferably an annular type.

The control for THRT 26 in the embodiment of FIG. 7 is achieved through an umbilical line 112 containing multiple hydraulic lines and an annulus line is run inside riser 16 from the surface to the THRT for control of the various functions on the tool.

Umbilical protection is achieved by having an umbilical protection sub 114 located in the landing string above THRT 26. Umbilical protection sub 114 is a tubular metal body that forms part of the landing string 30.

Figure 8A:
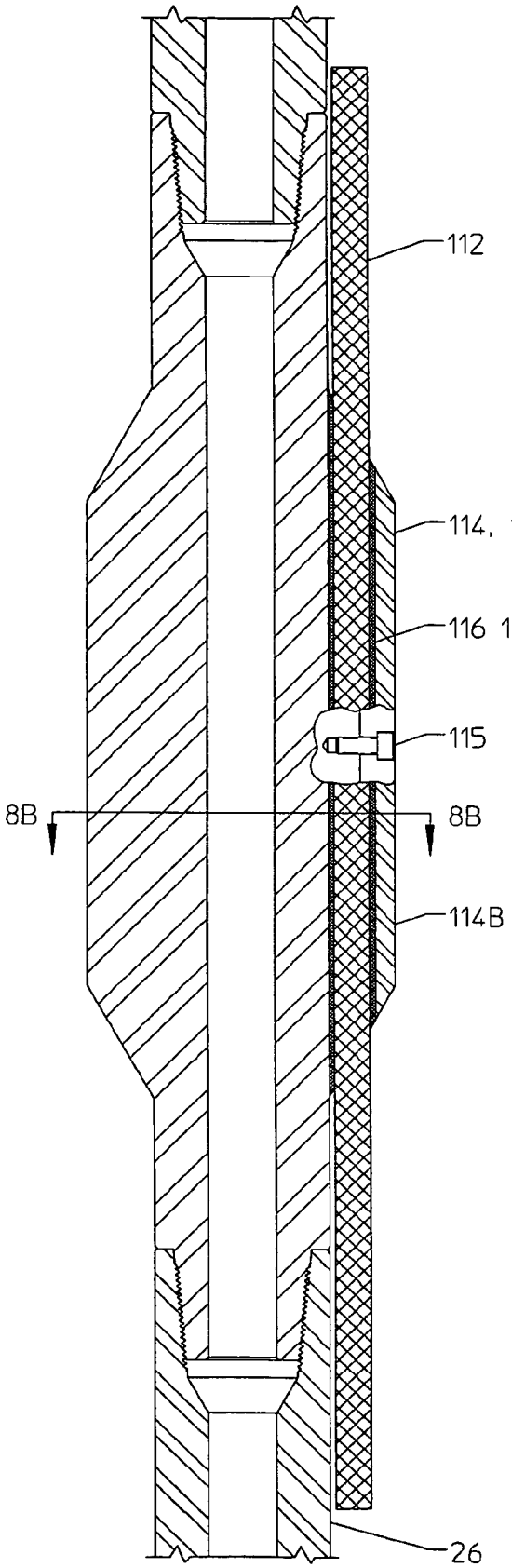
FIG. 8A is a side cross-sectional view of one implementation of an umbilical protection sub from the embodiment of FIG. 7.
Figure 8B:
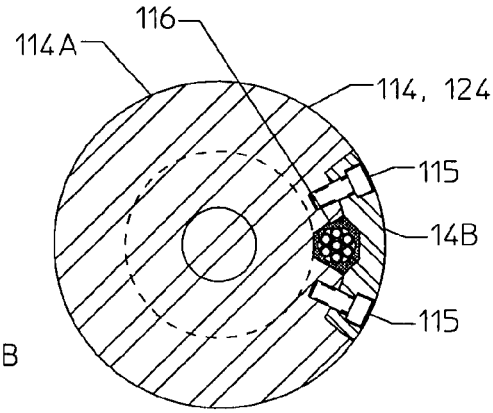
FIG. 8B is an axial cross-sectional view of the umbilical protection sub from FIG. 8A.

FIGS. 8A and 8B, 9, and 10 show alternative manners in which umbilical protection sub 114 may be constructed. In the embodiment of FIGS. 8A and 8B, umbilical protection sub 114 comprises two mating components 114A and 114B coupled together by means of a plurality of bolts 115. A passageway is defined between mating components 114A and 114B through which umbilical line 112 runs. An annular, resiliant seal 116 surrounds and seals umbilical 112 within sub 114.

Figure 9:
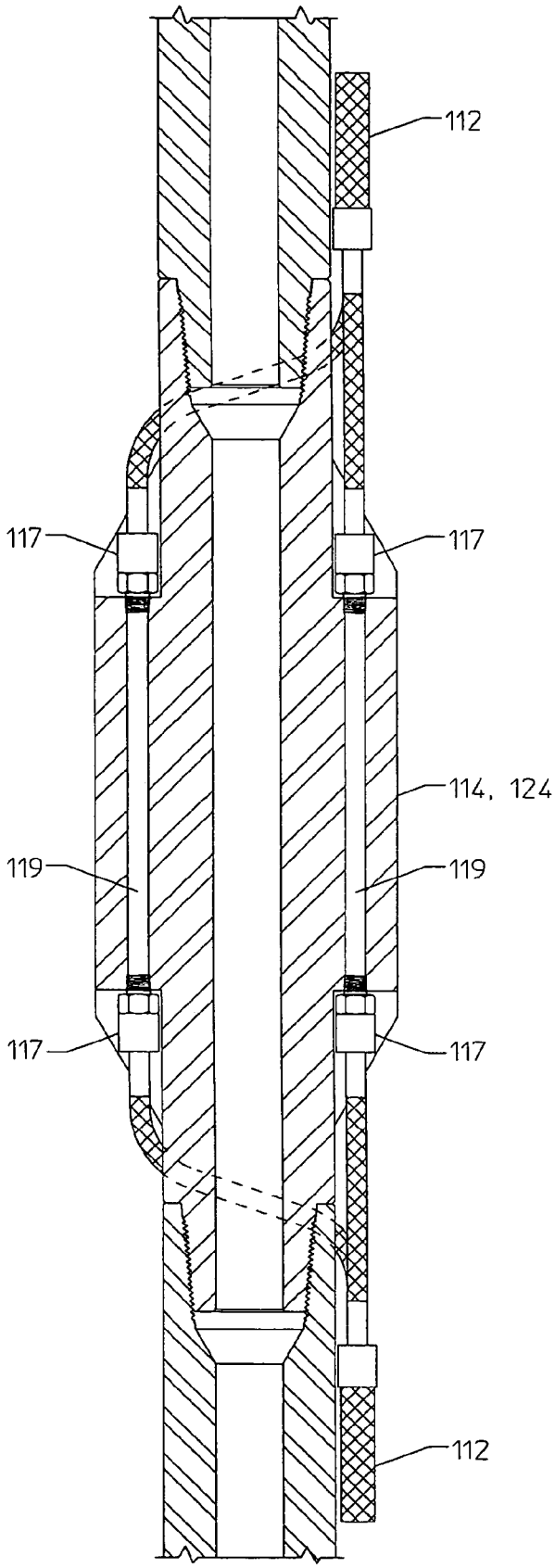
FIG. 9 is a side cross-sectional view of an alternative implementation of an umbilical proection sub from the embodiment of FIG. 7.

In the embodiment of FIG. 9, umbilical protection sub 114 is provided with a plurality of fittings 117 adapted to be coupled to upper and lower segments 112A and 112B of umbilical 112. Within sub 114 in the embodiment of FIG. 9, the hydraulic control pressures are communicated through internal channels 119.

Figure 10:
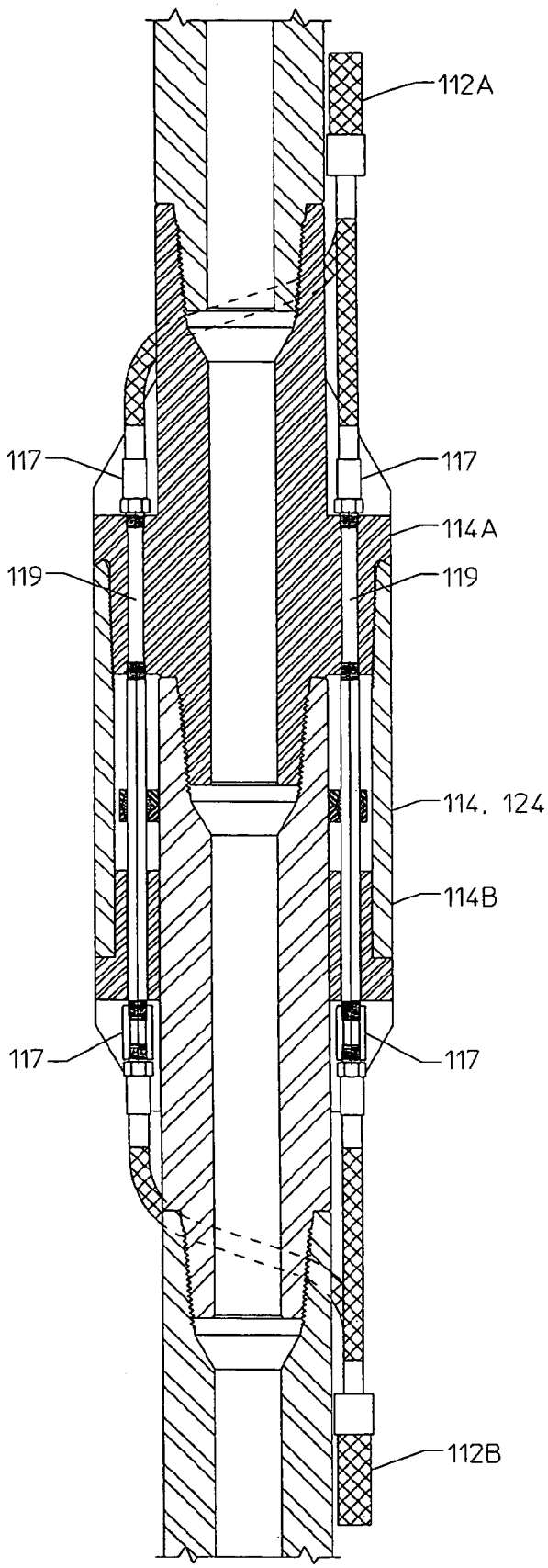
FIG. 10 is a side cross-sectional view of another alternative implementation of an umbilical proection sub from the embodiment of FIG. 7.

Similarly, in the embodiment of FIG. 10, umbilical protection sub 114 is provided with a plurality of fittings 117 for detachable attachment to upper and lower segments 112A and 112*b*, respectively, of umbilical 112. In the embodiment of FIG. 10, umbilical protection sub 114 comprises two threadably mating portions 114A and 114B, and channels 119 are segmented to permit separation of mating portions 114A and 114B.

Figure 11:
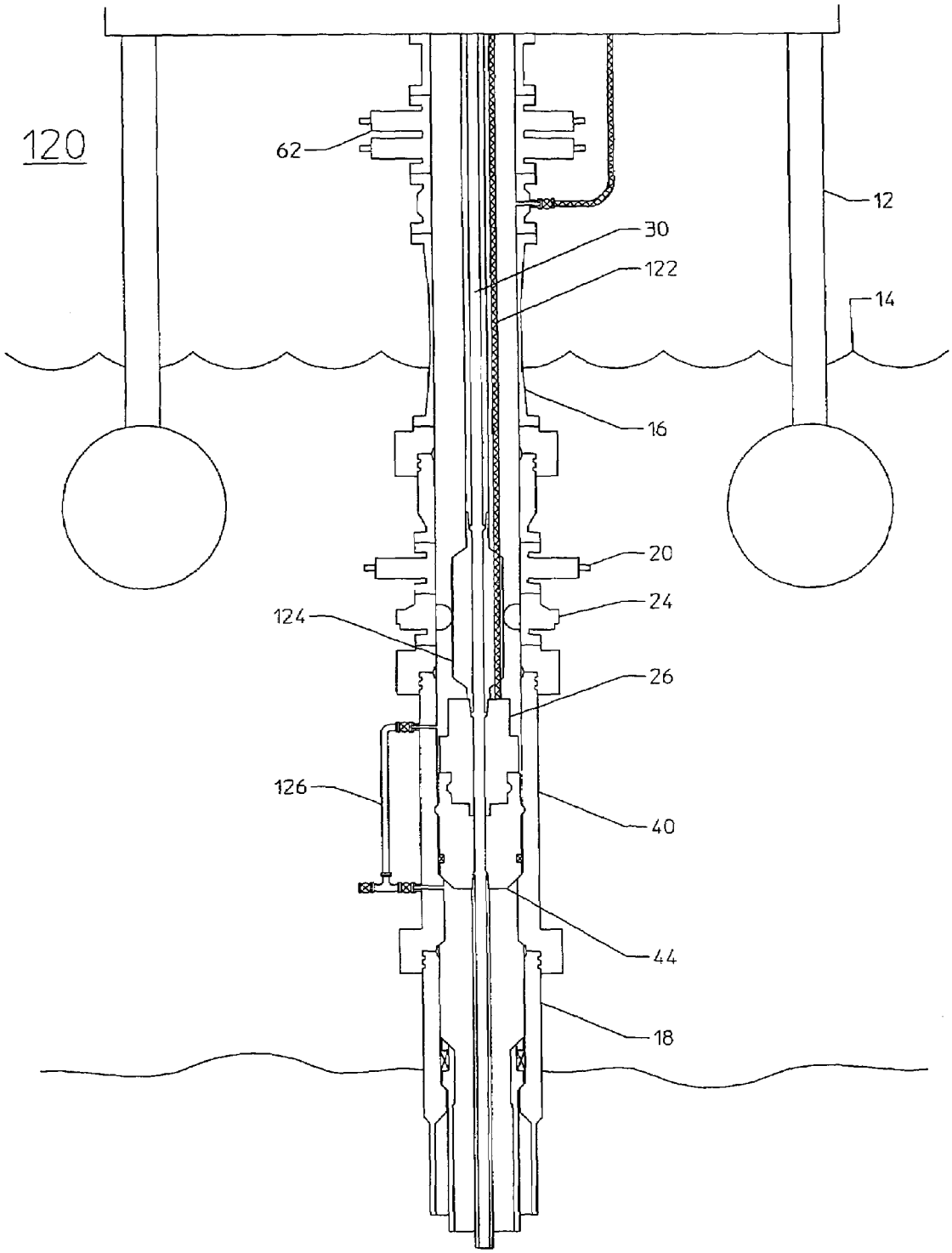
FIG. 11 is a subsea drilling/completion system in accordance with one of several alternative embodiments of the invention.

Turning now to FIG. 11, there is shown a subsea drilling/completion system in accordance with another embodiment of the invention. In the embodiment of FIG. 11, BOP protection is achieved by use of subsea BOP 20, which is preferably an annular type.

Control for THRT 26 in the embodiment of FIG. 11 is provided through a control umbilical 122, containing multiple hydraulic lines run inside riser 16 and along the outside of landing string 30 from the surface to THRT 26 for control of the various functions on the tool.

Umbilical protection is achieved by having an umbilical protection sub 124 located in landing string 30 above THRT 26. Again, reference is made to FIGS. 8A and 8B; 9, and 10 for details as to how this sub 124 may be constructed.

Figure 12:
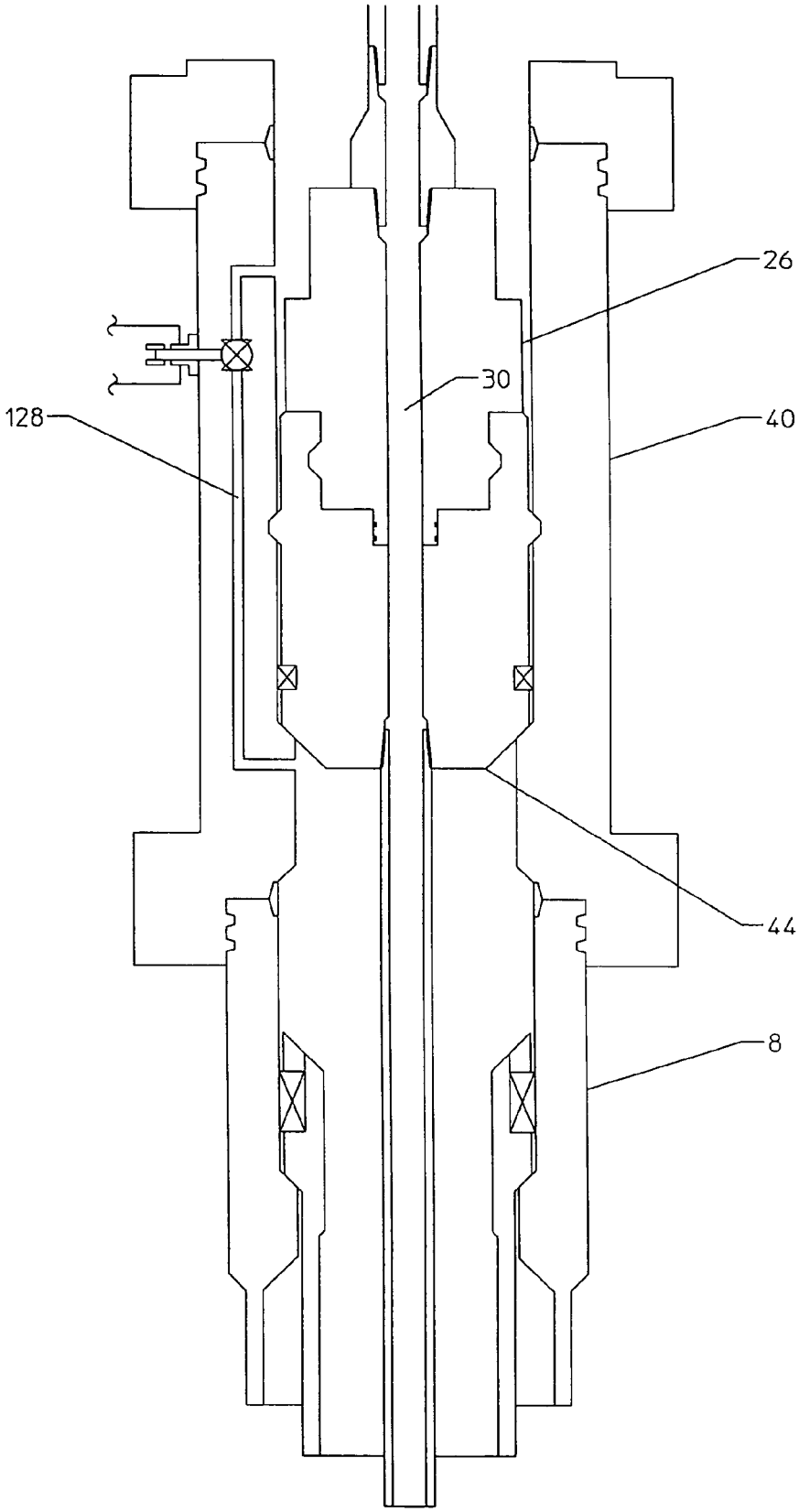
FIG. 12 is a side cross-sectional view of a portion of the subsea drilling/completion system of FIG. 11 showing an alternative annulus circulation path.

Annulus circulation in the embodiment of FIG. 11 is achieved by closing subsea BOP 20 and taking circulation from below tubing hanger 44 via an external jumper 126 outside tubing head 44, to above THRT 26 and then though the area below subsea BOP 20 to the annulus line in the internal umbilical. FIG. 12 shows an alternate circulation path 128 which extends through the tubing head 40 in the embodiment of FIG. 11.

Pressure testing on top of tubing hanger 44 in the embodiment of FIG. 11 is achieved by closing subsea BOP 20, closing valves as appropriate and then pressuring down one of the hydraulic lines in internal umbilical 122 to the area below the subsea BOP 20 and the top of THRT 26.

Figure 13:
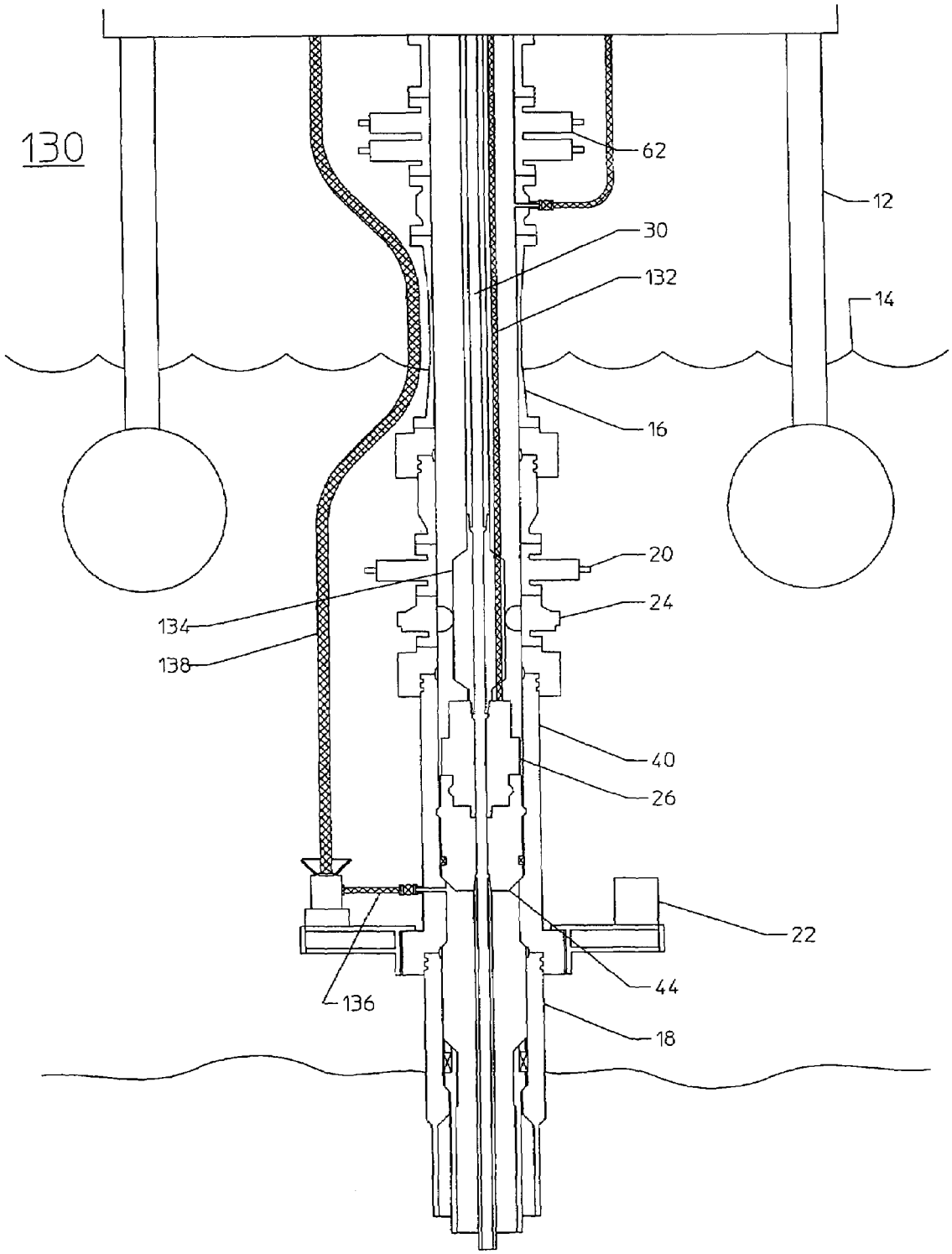
FIG. 13 is a side cross-sectional view of a subsea drilling/completion system in accordance with one of several alternative embodiments of the invention.

Turning now to FIG. 13, there is shown a subsea drilling/completion system 130 in accordance with still another embodiment of the invention. In the embodiment of FIG. 13, BOP operation is achieved by use of subsea BOP 20, which is preferably of the annular type.

Control for THRT 26 is provided through a control umbilical 132 containing multiple hydraulic lines is run inside riser 16 and along the outside of landing string 30 from the surface to THRT 26 for control of the various functions on the tool.

Umbilical protection is achieved by having an umbilical protection sub 134 located in landing string 30 above THRT 26. Again, reference is made to FIGS. 8A and 8B, 9, and 10 for details as to how this sub 124 may be constructed.

Annulus circulation in the embodiment of FIG. 13 is achieved by closing subsea BOP 20 and taking circulation from below tubing hanger 44 via an external jumper 136 outside the tubing head to an external umbilical 138 outside riser 16. External umbilical 138 might also contain hydraulic power or control lines.

Pressure test on top of tubing hanger 44 is achieved by closing subsea BOP 20, closing valves as appropriate and then pressuring down one of the hydraulic lines in internal umbilical 132 to the area below subsea BOP 20 and the top of THRT 26.

Figure 14:
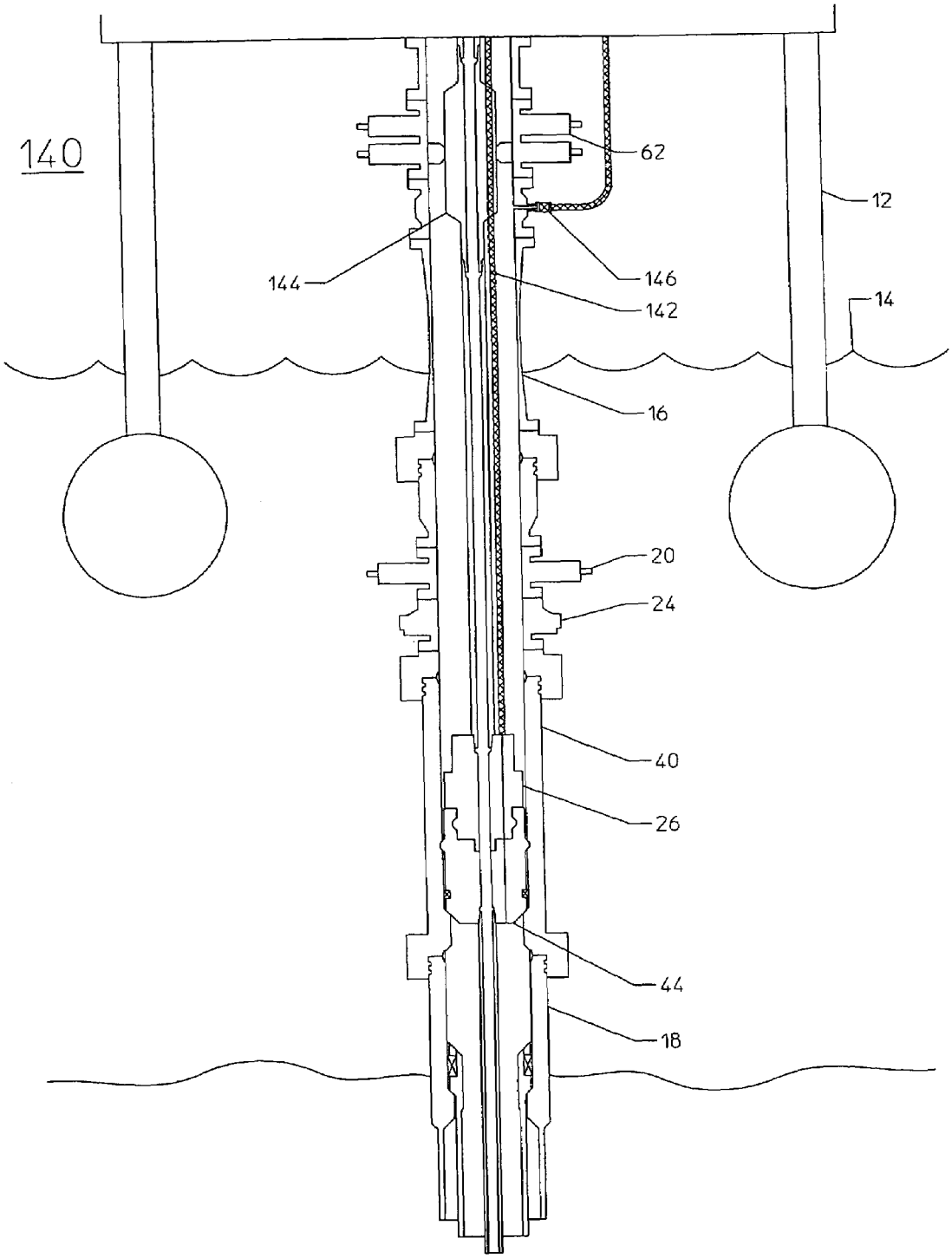
FIG. 14 is a side cross-sectional view of a subsea drilling/completion system in accordance with one of several alternative embodiments of the invention.

Turning now To FIG. 14, there is shown a subsea drilling/completion system 140 in accordance with still another embodiment of the invention. In the embodiment of FIG. 14, BOP operation is achieved through use of surface BOP 62. Control for THRT 26 is provided through a control umbilical 142 containing multiple hydraulic lines and an annulus line is run inside riser 16 from the surface to 26 THRT for control of the various functions on the tool. Umbilical protection is achieved by having an umbilical protection sub 144 located in the landing string opposite surface BOP 62. Once again, reference is made to FIGS. 8A and 8B, 9, and 10 for details as to how this sub 124 may be constructed.

Annulus circulation in the embodiment of FIG. 14 is achieved by an annulus line in internal umbilical 142 which communicates through THRT 26 and then through tubing hanger 44 to the annulus below tubing hanger 44.

Pressure test on top of tubing hanger is achieved by closing surface BOP 62, and then pressuring down one of the hydraulic lines in internal umbilical 142 to the area below surface BOP 62 and the top of THRT 26 inside riser 16, or pressuring the inside of riser 16 through a port 146 below the rams of surface BOP 62.

Figure 15:
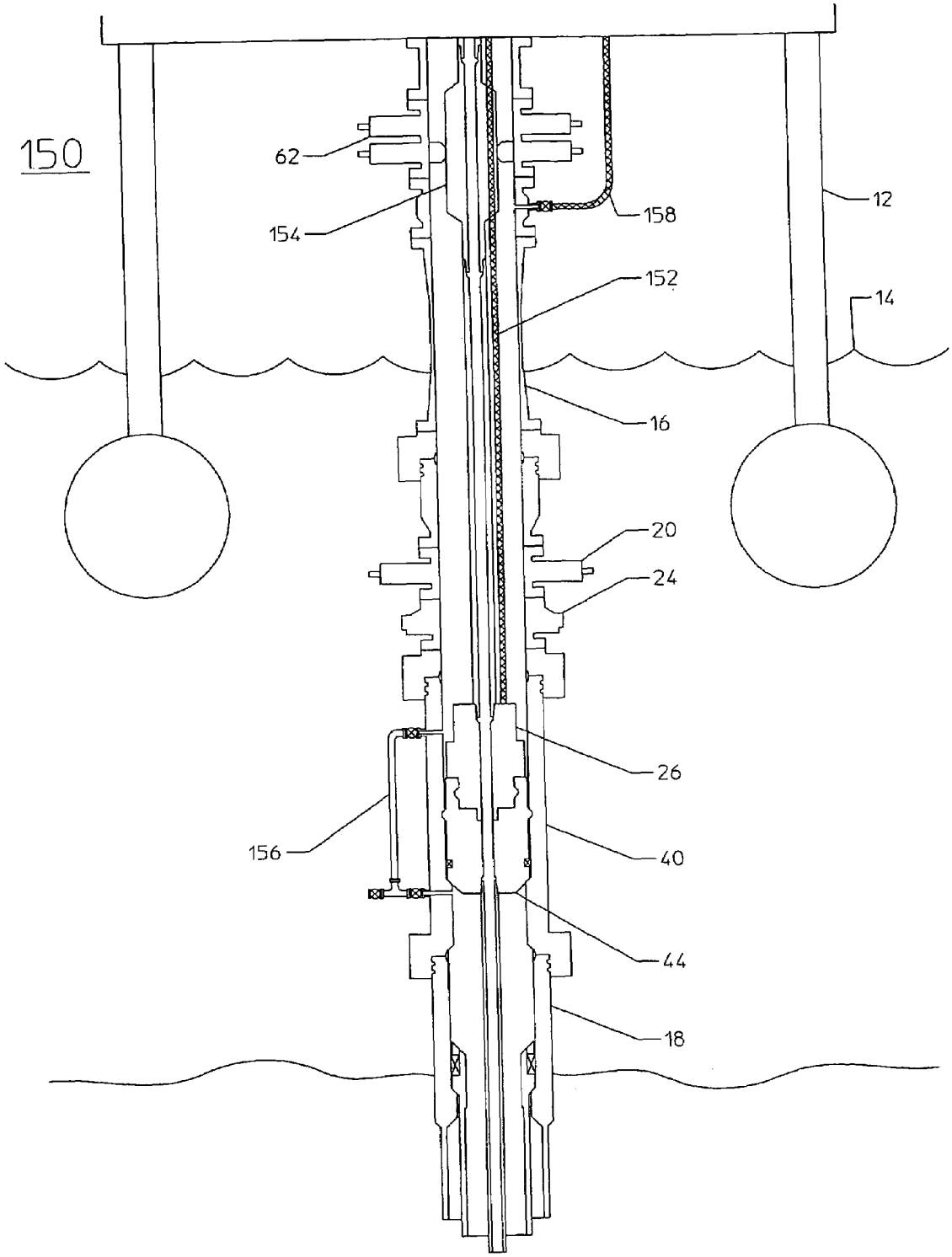
FIG. 15 is a side cross-sectional view of a subsea drilling/completion system in accordance with one of several alternative embodiments of the invention.

Turning now to FIG. 15, there is shown a subsea drilling/completion system 150 in accordance with still another embodiment of the invention. In the embodiment of FIG. 15, BOP operation is achieved though use of surface BOP 62. Control for THRT 26 is provided through a control umbilical 152 containing multiple hydraulic lines is run inside riser 16 and along the outside of the landing string from the surface to THRT 26 for control of the various functions on the tool.

Umbilical protection in the embodiment of FIG. 15 is achieved by having an umbilical protection sub 154 located in the landing string opposite surface BOP 62. Once again, reference is made to FIGS. 8A and 8B, 9, and 10 for details as to how this sub 124 may be constructed.

Annulus circulation in the embodiment of FIG. 15 is achieved by closing surface BOP 62 and taking circulation from below tubing hanger 44 via an external jumper 156 outside tubing head 40, to above THRT 26 and then through the area below subsea BOP 20 to the inside of riser 16 above THRT 26. Circulation is then taken out the annulus circulation line below the surface BOP through a port 158. FIG. 12, referenced above, shows an alternate circulation path through tubing head 40.

Pressure test on top of tubing hanger 44 in the embodiment of FIG. 15 is achieved by closing surface BOP 62, closing valves as appropriate, and then pressuring the inside of is riser 16 through the annulus circulation line below surface BOP 62.

Figure 16:
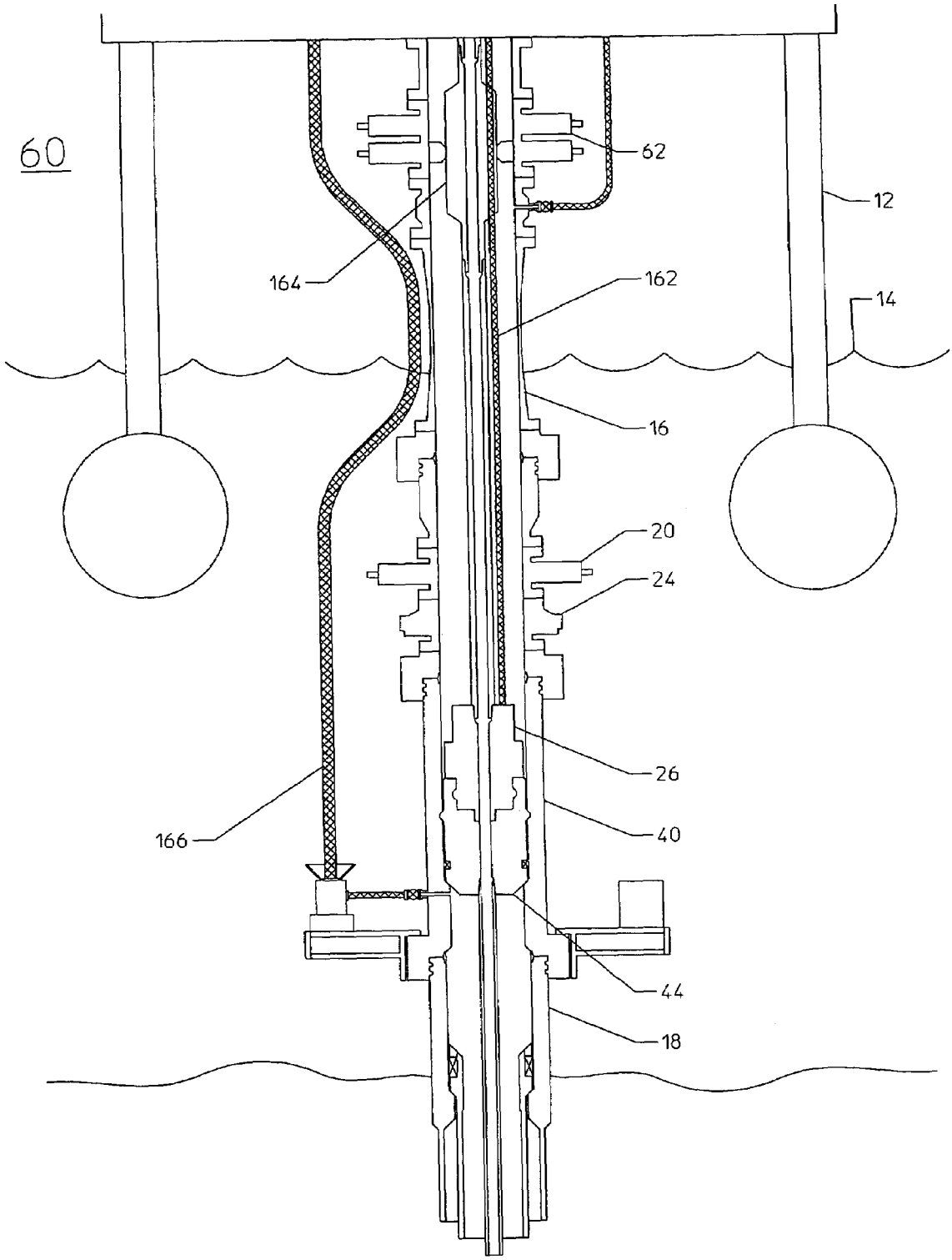
FIG. 16 is a side cross-sectional view of a subsea drilling/completion system in accordance with one of several alternative embodiments of the invention.

Turning now to FIG. 16, there is shown a subsea drilling/completion system 160 in accordance with still another embodiment of the invention. In the embodiment of FIG. 16, BOP protection is achieved by use of surface BOP 62. Control for THRT 26 is achieved as follows: A control umbilical 162 containing multiple hydraulic lines is run inside riser 16 and along the outside of the landing string from the surface to THRT 26 for control of the various functions on the tool.

Umbilical protection in the embodiment of FIG. 16 is achieved by having an umbilical protection sub 164 located in the landing string opposite surface BOP 62. Again, reference is made to FIGS. 8A and 8B, 9, and 10 for details as to how this sub 124 may be constructed.

Annulus circulation in the embodiment of FIG. 16 is achieved by taking circulation from below tubing hanger 44 via an external umbilical 166 outside the riser. External umbilical 166 may in some embodiments also contain hydraulic power or control lines.

Pressure test on top of tubing hanger 44 is achieved in the embodiment of FIG. 16 by closing the surface BOP 62, closing valves as appropriate, and then pressuring down one of the hydraulic lines in internal umbilical 162 to the area below subsea BOP 20 and the top of THRT 26, or by pressuring inside riser 16 through the annulus line just below surface BOP 62.

Figure 17:
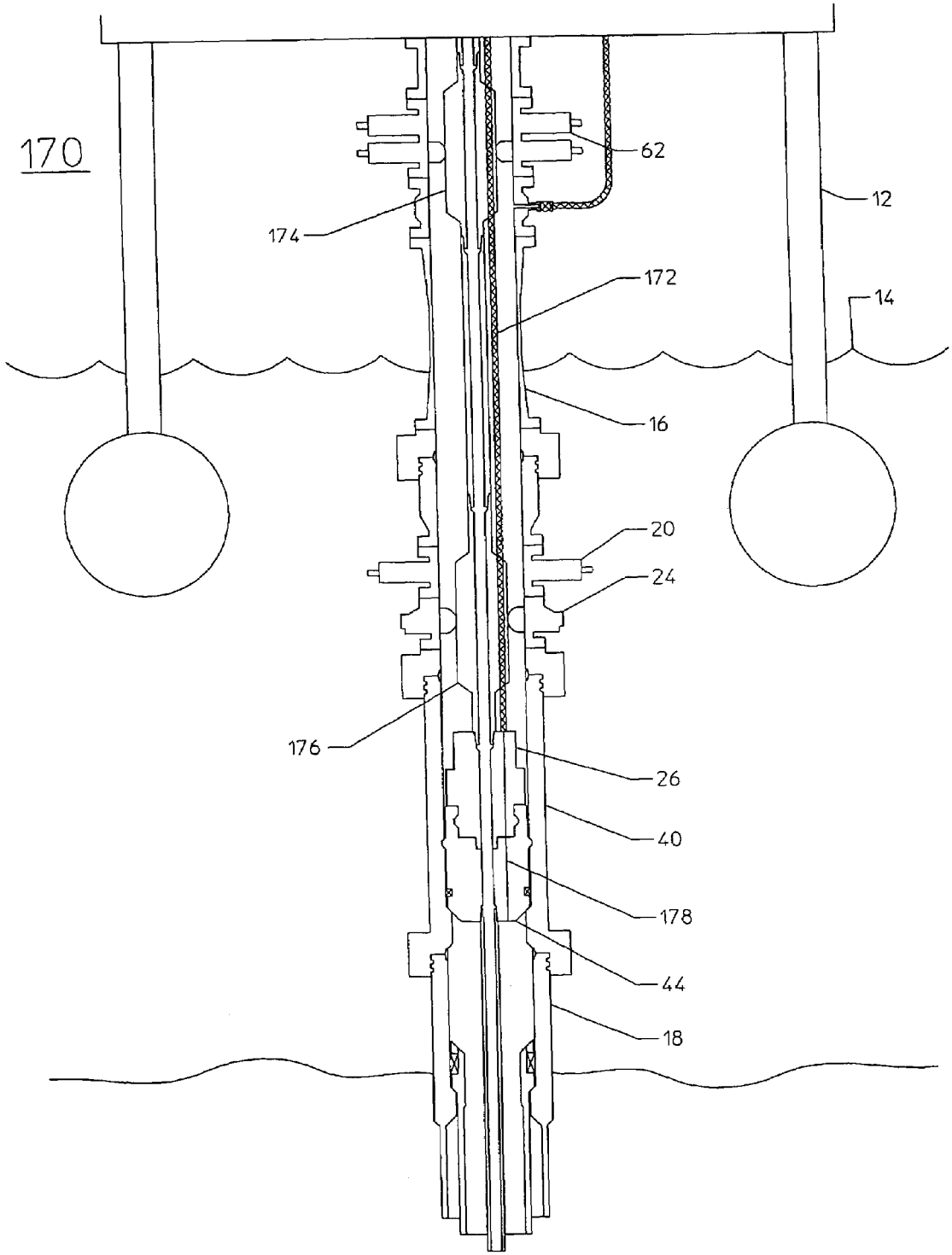
FIG. 17 is a side cross-sectional view of a subsea drilling/completion system in accordance with one of several alternative embodiments of the invention.

Turning now to FIG. 17, there is shown a subsea drilling/completion system 170 in accordance with still another embodiment of the invention. In the embodiment of FIG. 17, BOP operation is provided through use of either subsea BOP 20 or the surface BOP 62. Control for THRT 26 is achieved through a control umbilical 172 containing multiple hydraulic lines is run inside riser 16 and along the outside of the landing string from the surface to THRT 26 for control of the various functions on the tool.

Umbilical protection in the embodiment of FIG. 17 is achieved by having umbilical protection subs 174 and 176 located in the landing string opposite both surface BOP 62 and subsea BOP 20, respectively. Again, reference is made to FIGS. 8A and 8B, 9, and 10 for details as to how this sub 124 may be constructed.

It is to be noted that in the embodiment of FIG. 17, two protection subs, 174, and 176, are provided, to maximize safety in the event of unintended closure of a BOP.

Annulus circulation in the embodiment of FIG. 17 is achieved by taking circulation from below tubing hanger 44 via an internal port 178 in the tubing hanger 44 and then up through THRT 26. This port 178 then connects to a conduit in internal umbilical 172 which is protected by protection subs 174 and 176.

Pressure test on top of tubing hanger is achieved by closing surface BOP 62 or subsea BOP 20, closing valves as appropriate, and then pressuring down one of the hydraulic lines in internal umbilical 172 to the area below subsea BOP 20 and the top of THRT 26, or by pressuring inside riser 16 through the annulus line just below surface BOP 62 with subsea BOP 20 open.

Figure 18:
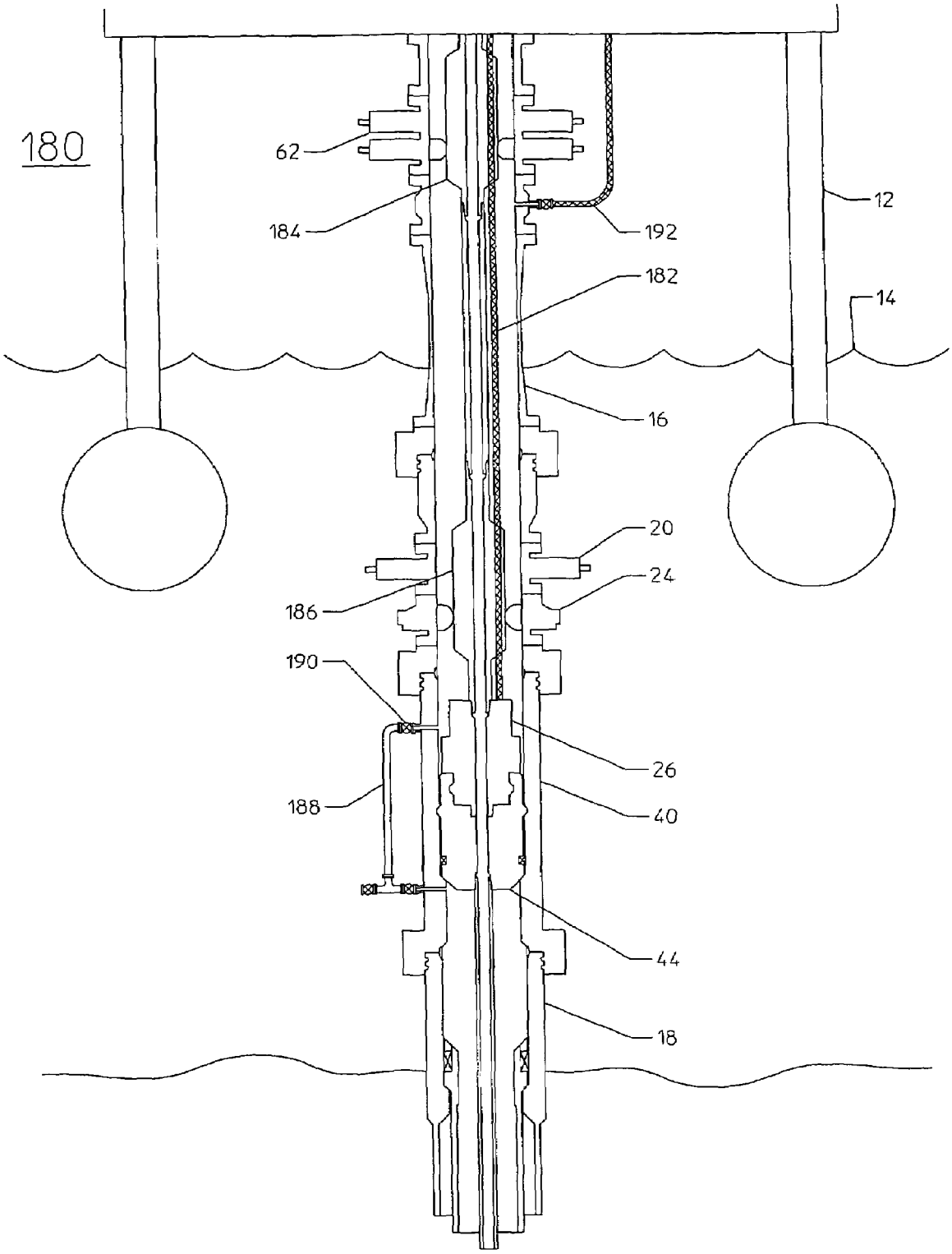
FIG. 18 is a side cross-sectional view of a subsea drilling/completion system in accordance with one of several alternative embodiments of the invention.

Turning now to FIG. 18, there is shown a subsea drilling/completion system 180 in accordance with still another embodiment of the invention. In the embodiment of FIG. 18, BOP operation is achieved via either subsea BOP 20 or surface BOP 62. Control for THRT 26 is achieved through a control umbilical 182 containing multiple hydraulic lines run inside riser 16 and along the outside of the landing string from the surface to THRT 26 for control of the various functions on the tool.

Umbilical protection in the embodiment of FIG. 18 is achieved by having umbilical protection subs 184 and 186 located in the landing string opposite surface BOP 62 subsea BOP 20, respectively. Again, reference is made to FIGS. 8A and 8B, 9, and 10 for details as to how this sub 124 may be constructed.

And, again, two protection subs are used to maximize safety in the event of un-intended closure of a BOP.

Annulus circulation is achieved by taking circulation from below tubing hanger 44 via an external line 188 in tubing head 40, up to a port in tubing head 44, back into tubing head 44 above THRT 26, and then out the annulus circulation line below surface BOP 62 through a line 192.

Pressure test on top of tubing hanger is achieved by closing surface BOP 62 or subsea BOP 20, closing valves as appropriate, and then pressuring down one of the hydraulic lines in internal umbilical 182 to the area below subsea BOP 20 and the top of THRT 26, or by pressuring inside riser 16 through annulus line 192 just below surface BOP 62 with subsea BOP 20 open.

Figure 19:
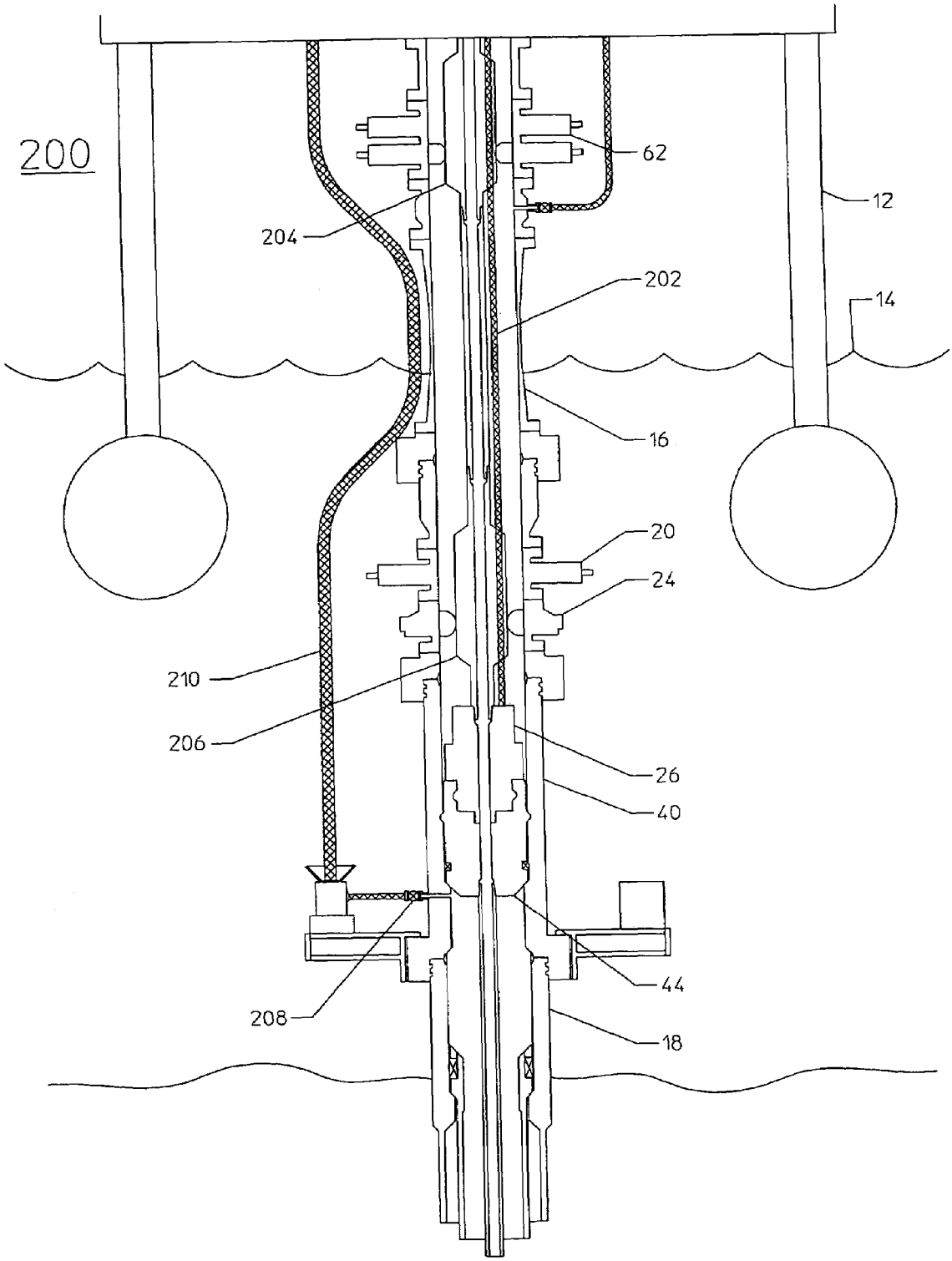
FIG. 19 is a side cross-sectional view of a subsea drilling/completion system in accordance with one of several alternative embodiments of the invention.

Turning now to FIG. 19, there is shown a subsea drilling/completion system 200 in accordance with still another embodiment of the invention. In the embodiment of FIG. 19, BOP operation is achieved with either subsea BOP 20 or surface BOP 62. Control for THRT 26 is provided through a control umbilical 202 containing multiple hydraulic lines is run inside riser 16 and along the outside of the landing string from the surface to THRT 26 for control of the various functions on the tool.

Umbilical protection in the embodiment of FIG. 19 is achieved by having umbilical protection subs 204 and 206 located in the landing string opposite surface BOP 62 and subsea BOP 20, respectively. Again, reference is made to FIGS. 8A and 8B, 9, and 10 for details as to how this sub 124 may be constructed.

And again, two protection subs are used to maximize safety in the event of un-intended closure of a BOP.

Annulus circulation is achieved in the embodiment of FIG. 19 by taking circulation from below tubing hanger 44 via a port 208 in tubing head 40, up through an external umbilical line 210 located outside riser 16. External umbilical 210 might also include hydraulic power and/or control lines for valves or subsea BOP's.

Pressure test on top of tubing hanger is achieved by closing surface BOP 62 or subsea BOP 20, closing valves as appropriate, and then pressuring down one of the hydraulic lines in internal umbilical 202 to the area below subsea BOP 20 and the top of THRT 26, or by pressuring inside riser 16 through an annulus line 210 just below surface BOP 62 with subsea BOP 20 open.

Figure 20:
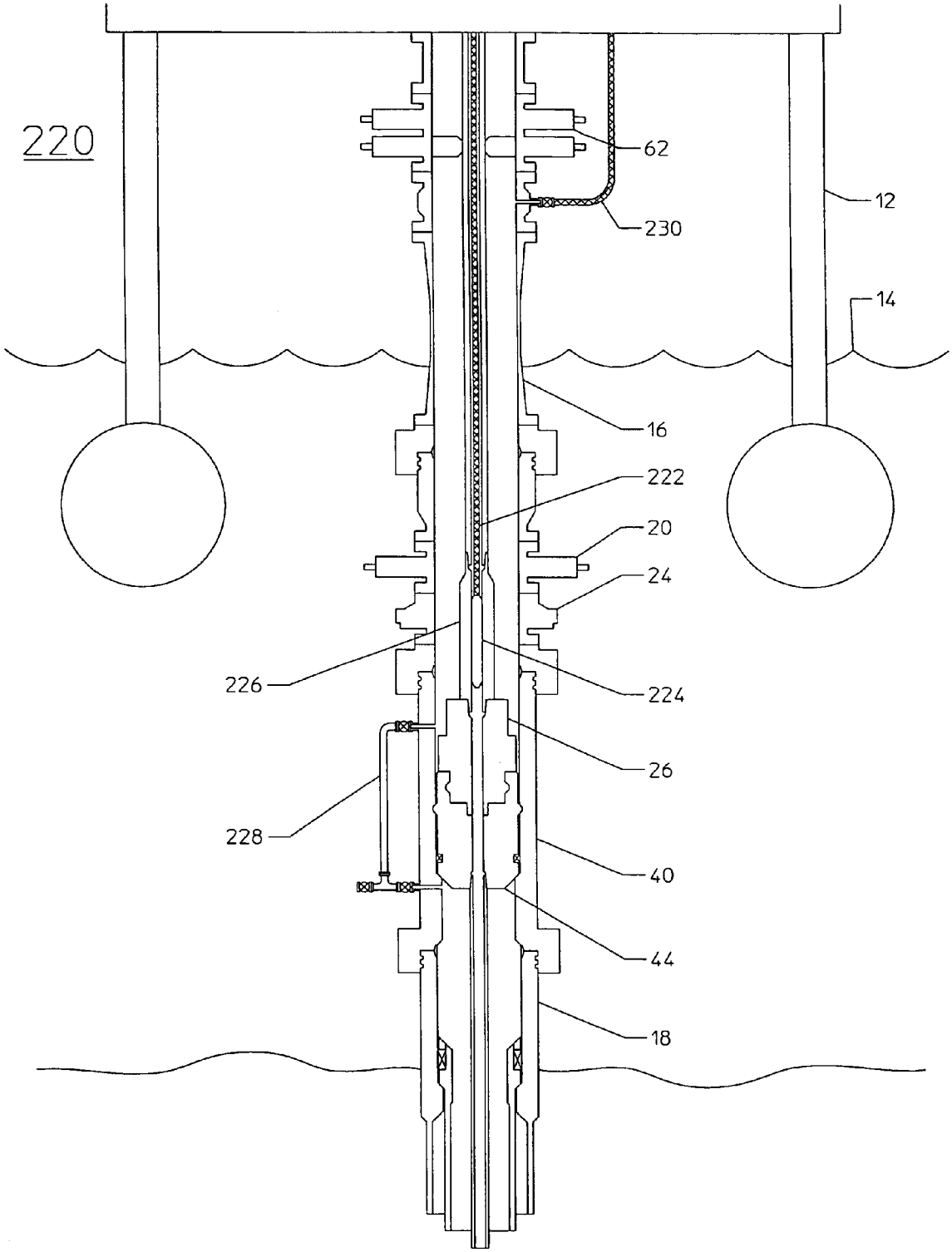
FIG. 20 is a side cross-sectional view of a subsea drilling/completion system in accordance with one of several alternative embodiments of the invention.

Turning now to FIG. 20, there is shown a subsea drilling/completion system 220 in accordance with still another embodiment of the invention. In the embodiment of FIG. 20, BOP protection is achieved by use of subsea BOP 20. Control for THRT 26 is achieved as follows: A control umbilical 222 containing multiple hydraulic lines is run inside the landing string and terminates in a multi-ported dart 224. Dart 224 seals to a dart sub 226 located above THRT 26.

In the embodiment of FIG. 20, internal umbilical 222 can be pulled and re-run as needed during a completion operation so that the inside of the landing string can be used for conventional operations.

Figure 21:
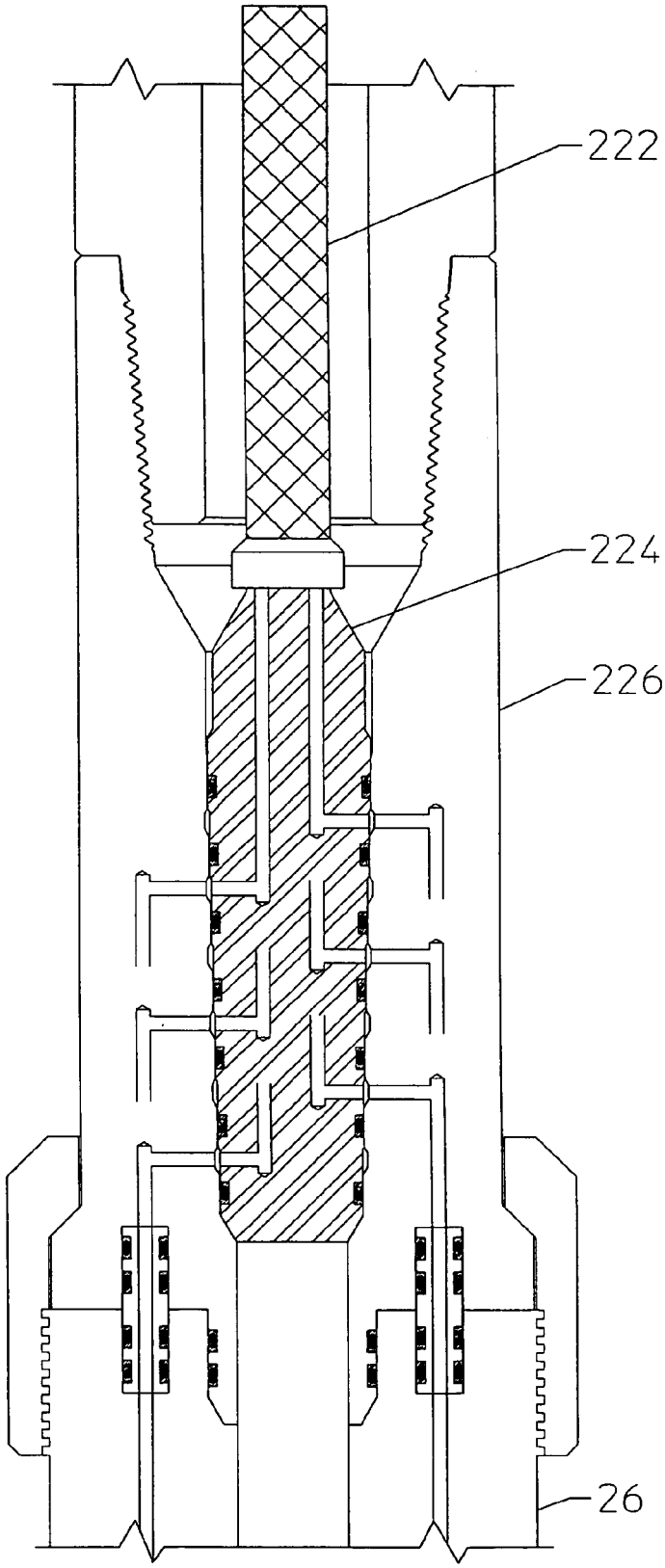
FIG. 21 is a side cross-sectional view of a dart sub element in the embodiment of FIG. 20.

FIG. 21 shows some details of how dart sub 226 is constructed in one embodiment of the invention, and how it seals to dart 224. As shown in FIG. 21, dart 224 and dart sub 226 cooperate to function essentially as a manifold for diversion of various hydraulic lines in umbilical 222 though to THRT 26.

Umbilical protection in the embodiment of FIG. 20 is achieved by having umbilical 222 located inside the landing string where it cannot be damaged by closing the BOP.

Annulus circulation in the embodiment of FIG. 20 is achieved by taking circulation from below tubing hanger 44 via external plumbing 228, then back into the tubing head above THRT 26 and then inside riser 16 (outside of the landing string) and up through annulus circulation line 230 which is below surface BOP 62. FIG. 12, described above, shows an alternate means of porting the annulus line in tubing head 40.

Pressure test on top of tubing hanger 44 is achieved by closing surface BOP 62, closing valves as appropriate, and then pressuring down annulus circulation line 230 which will pressure the inside of riser 16 above THRT 26.

Figure 22:
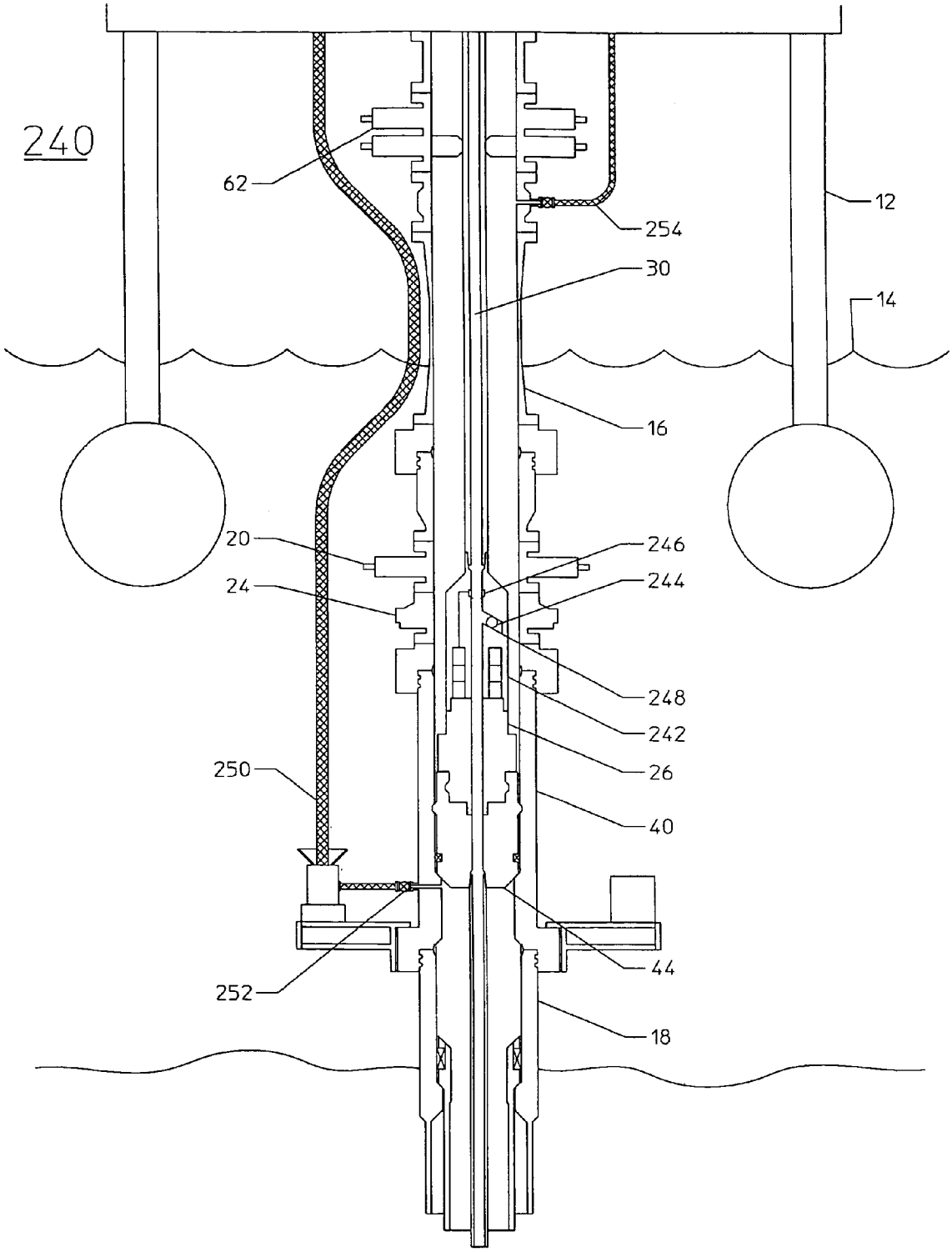
FIG. 22 is a side cross-sectional view of a subsea drilling/completion system in accordance with one of several alternative embodiments of the invention.
Figure 23:
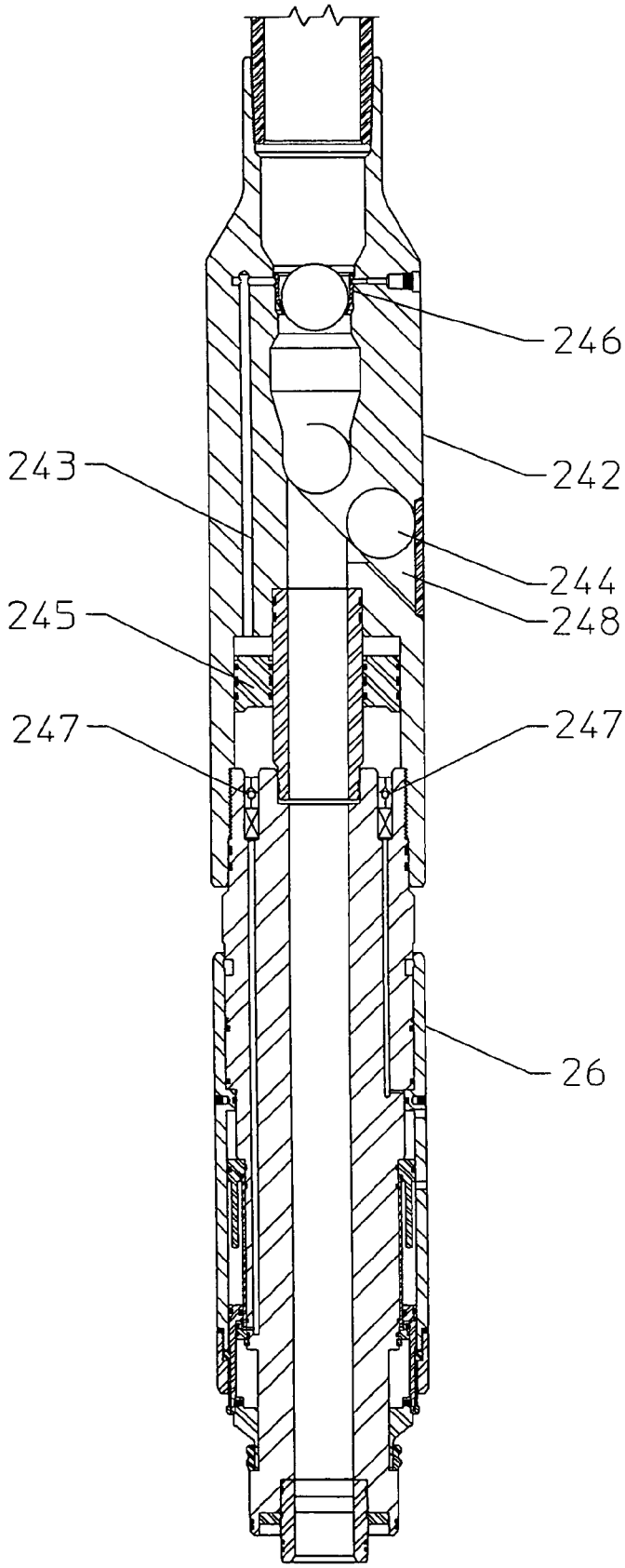
FIG. 23 is a side cross-sectional view of a ball drop actuation sub component in the embodiment of FIG. 22.

Turning now to FIG. 22, there is shown a subsea drilling/completion system 240 in accordance with still another embodiment of the invention. In the embodiment of FIG. 22, BOP protection is achieved by use of surface BOP 62. Control for THRT 26 is achieved as follows: A ball drop actuation sub 242 is included in the landing string above THRT 26. Details of implementation of ball drop actuation sub 242 are shown in FIG. 23. In operation, a ball 244 is dropped down the landing string and lands in a seat 246 in actuation sub 242. Pressure is applied down the landing string and communicated through a port 243 and applied against an annular piston 245. Piston 245 in turn actuates a sequential set of valves 247 to operate various functions of THRT 26.

After operation of THRT 26 is complete, the pressure in the landing string is increased to pump ball 244 through seat 246 where it lands in a side pocket catch mandrel 248, re-opening sub 242.

Umbilical protection in the embodiment of FIG. 22 is achieved by not having a control umibilical inside riser 16.

Annulus circulation in the embodiment of FIG. 22 is achieved by an external hose 250 running alongside and outside of riser 16 and terminating in a stab 252 on the base of tubing head 40. Annulus line 250 then goes to the tubing head and enters the tubing head below the tubing hanger. External umbilical line 250 may in some embodiments also include hydraulic power and control lines for subsea BOP 20.

Pressure test on top of tubing hanger 44 is achieved by closing surface BOP 62, opening subsea BOP 20, closing appropriate valves, and then pressuring down a pressure control line 254 to pressurize inside riser 16 below surface BOP 62.

Figure 24:
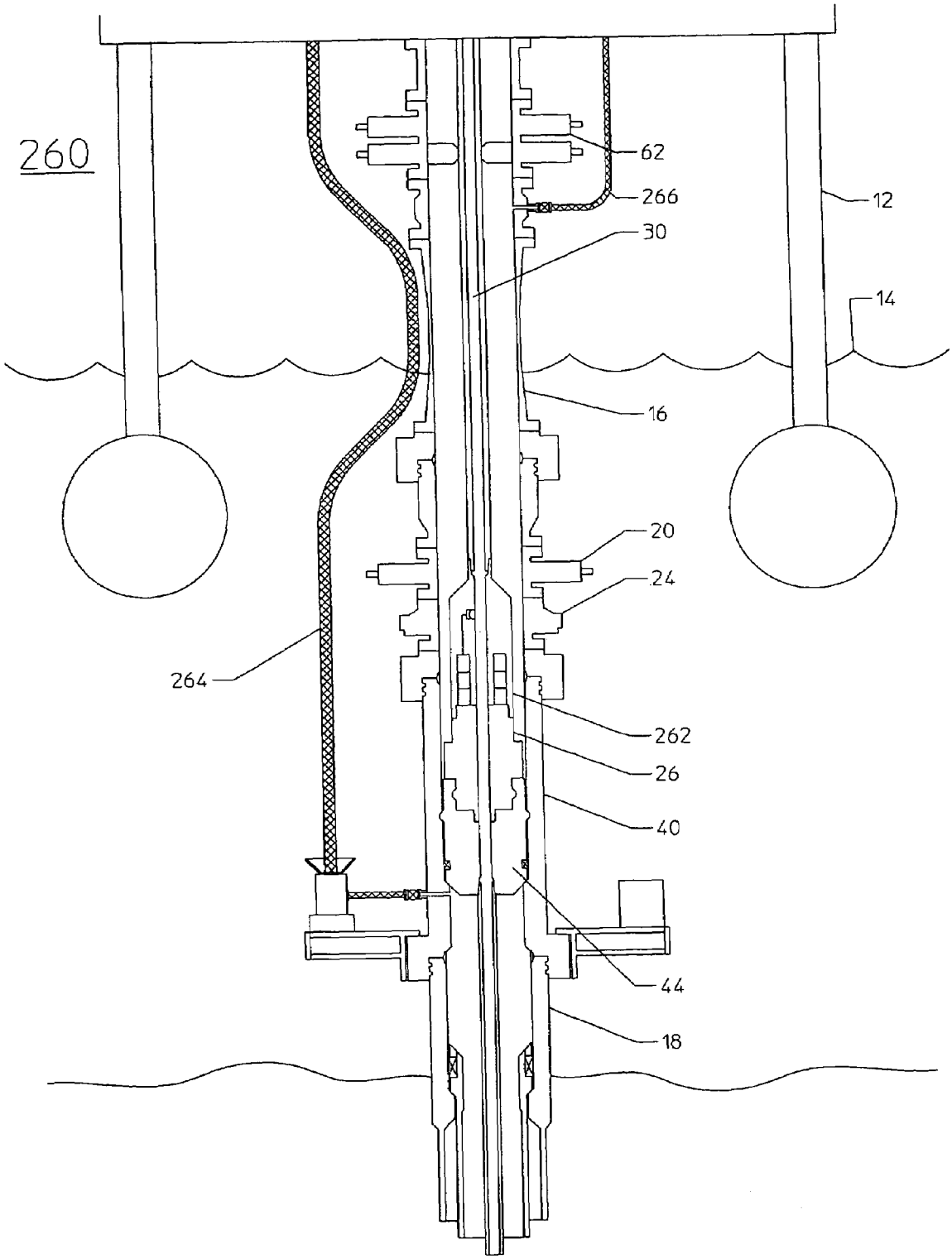
FIG. 24 is a side cross-sectional view of a subsea drilling/completion system in accordance with one of several alternative embodiments of the invention.

Turning now to FIG. 24, a subsea drilling/completion system 260 in accordance with still another embodiment of the invention is shown. In the embodiment of FIG. 24, BOP operation is provided by of surface BOP 62. Control for THRT 26 is provided by a rupture disk actuation sub 262 included in the landing string above THRT 26. An over pressure is applied down the landing string where it acts on a rupture disk which, when ruptured, allows fluid to enter a chamber which isolates fluid. The isolated fluid then can be pressured by pumping down the landing string to allow pressure to act on a set of sequential valves which operate various function of THRT 26.

Figure 25:
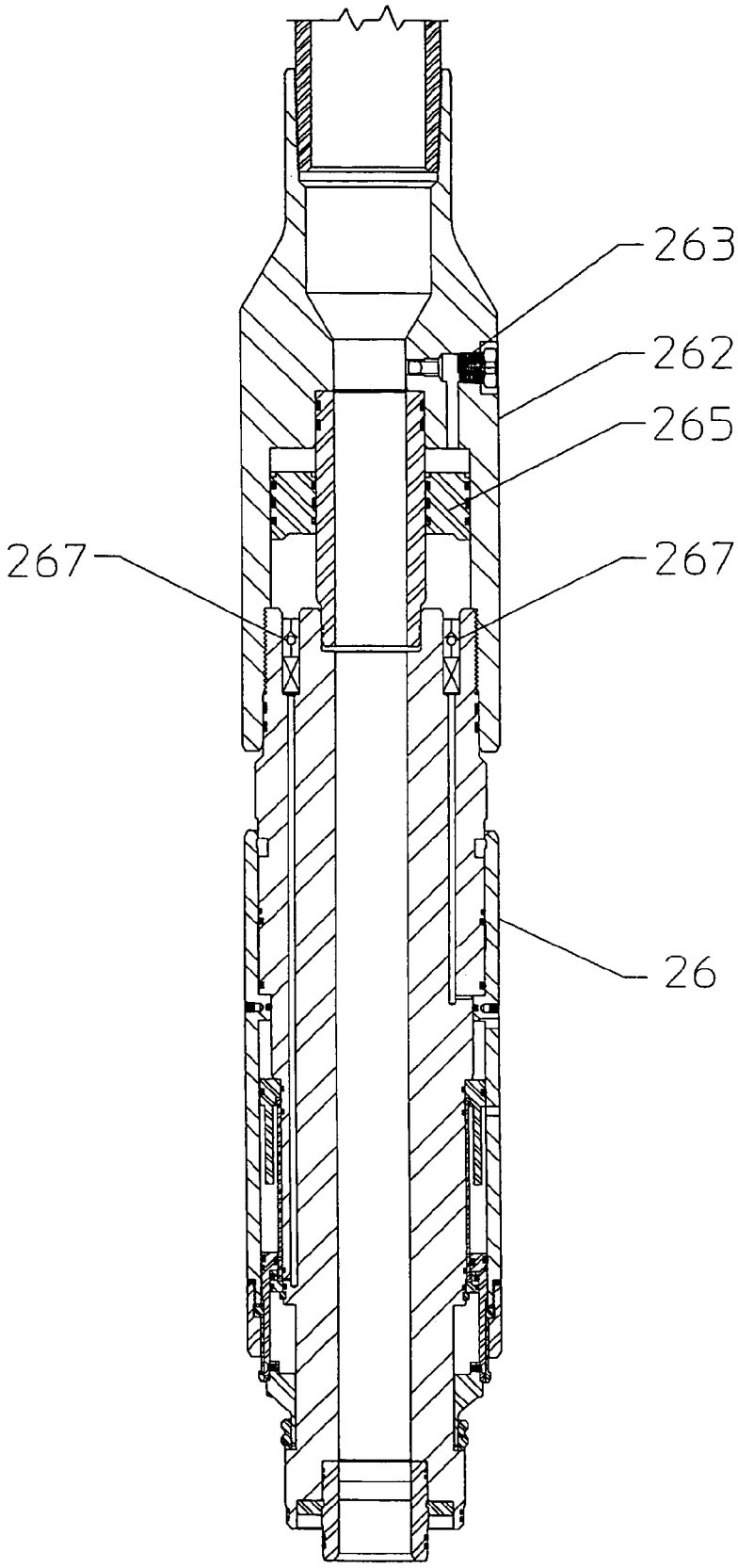
FIG. 25 is a side cross-sectional view of a rupture actuation disk component of the embodiment of FIG. 23.

FIG. 25 shows rupture disk actuation sub 262 in greater detail. Rupture disk actuation sub 262 includes a rupture disc 263, isolating the inside of the landing string 30 from the annulus formed between the riser 16 and the landing string. Actuation of sub 262 is achieved by pressurizing the inside of riser 16, causing disk 263 to rupture and allowing pressure to be applied against a piston 265. Piston 265, in turn, sequentially actuates a series of valves 267 to operate various functions of THRT 26.

Umbilical protection in the embodiment of FIG. 24 is achieved by not having a control umbilical inside riser 16.

Annulus circulation in the embodiment of FIG. 24 is achieved by an external umbilical line 264 run alongside and outside of riser 16 and terminating in a stab on the base of tubing head 40. The annulus line then goes from the stab to tubing head 40 and enters the tubing head below tubing hanger 44. External umbilical line 264 may also include hydraulic power and control lines for the subsea BOP such as the annular BOP.

Pressure test on top of tubing hanger 44 is achieved by closing surface BOP 62, closing appropriate valves, and then pressuring down a pressure control line 266 to pressurize inside riser 16 below surface BOP 62.

Figure 26:
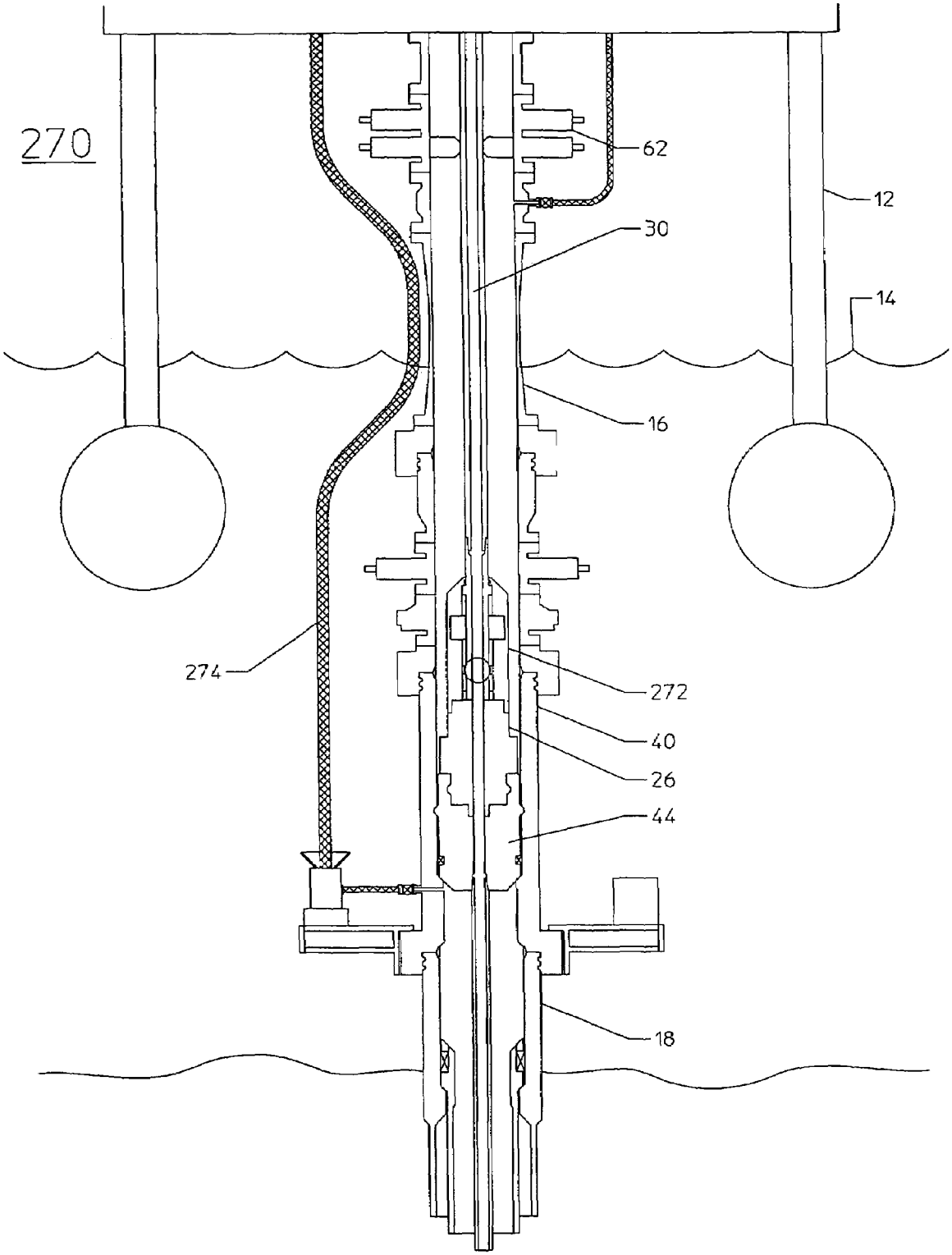
FIG. 26 is a side cross-sectional view of a subsea drilling/completion system in accordance with one of several alternative embodiments of the invention.

Turning now to FIG. 26, there is shown a subsea drilling/completion system 270 in accordance with still another embodiment of the invention. In the embodiment of FIG. 26, BOP protection is achieved by use of the surface BOP. Control for THRT 26 is provided by a push-pull cam-actuated ball valve and rotary switching valve sub 272 included in the landing string above THRT 26.

A ball valve 273 is contained in the sub 272. When running tubing head 40 and THRT 26, the ball valve 273 is locked in the open position. After landing tubing head 40, the landing string can be rotated to release the lock so that the string can be pulled and set down repeated times. By pulling up the ball valve is opened and by setting down the valve is closed.

Each time the string is pulled and set down, the switching valve also sequentially selects another hydraulic function on the THRT and the ball valve is closed. By setting down the landing string, the selected function on the tool is pressured and functioned.

Pulling up opens the ball valve and then full bore access is achieved down the landing string and tubing.

Umbilical protection in the embodiment of FIG. 26 is achieved by not having a control umbilical inside riser 16.

Annulus circulation in the embodiment of FIG. 26 is achieved by an external umbilical line 274 run alongside and outside of riser 16 and terminating in a stab on the base of tubing head 40. Annulus line then goes to the tubing head and enters the tubing head below the tubing hanger. External umbilical line 274 may also include hydraulic power and control lines for subsea BOP 20.

Pressure test on top of tubing hanger 44 in the embodiment of FIG. 26 is achieved by closing surface BOP 62, closing appropriate valves, and then pressuring down the pressure control line to pressurize inside riser 16 below surface BOP 62.

From the foregoing detailed description of specific embodiments of the invention, it should be apparent that methods and apparatuses for blowout prevention in subsea drilling/completion wells have been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested in the present disclosure, may be made to the disclosed embodiments without departing from the spirit and scope of the invention as defined by the appended claims, which follow.

What is claimed is:

1. A subsea drilling/completion system, comprising:

a high-pressure riser extending between a platform and a subsea wellhead;

a running string extending inside said riser;

a surface blowout preventer disposed on said riser above the sea surface;

a subsea blowout preventer below said sea surface and substantially adjacent to said subsea wellhead;

a tubing hanger disposed within or adjacent said subsea wellhead for suspending tubing in said well below said subsea wellhead;

a retrievable tubing hanger running tool adapted to be run the tubing hanger through said riser on the running string, disengage the tubing hanger, then return to the surface of the well with the tubing hanger within or adjacent the subsea wellhead;

wherein said tubing hanger running tool is controlled by hydraulic pressure.

2. A subsea drilling/completion system of claim 1, further comprising:

said tubing hanger running tool is controlled by hydraulic pressure communicated inside said riser and outside said landing string.

3. The subsea drilling/completion system of claim 1, further comprising:

said tubing hanger running tool is controlled by hydraulic pressure communicated through said landing string.

4. A subsea drilling/completion system of claim 1, further comprising:

said tubing hanger running tool is controlled by hydraulic pressure communicated through an umbilical line extending inside said riser and outside said landing string.

5. A subsea drilling/completion system of claim 4, further comprising:

a protective structure radially within the subsea blowout preventer and radially outward of the umbilical line for protecting said umbilical line when said subsea blowout preventer is closed around said landing string.

6. A subsea drilling/completion system of claim 5, wherein said protective structure comprises a ball drop activation sub.

7. A subsea drilling/completion system of claim 5, wherein said protective structure comprises a rupture disk actuation sub.

8. A subsea drilling/completion system of claim 5, wherein said protective structure comprises a substantially annular structure surrounding said landing string and having a conduit extending along its length adapted to receive said umbilical therein.

9. A subsea drilling/completion system of claim 4, further comprising a substantially annular sealing structure sealing said umbilical in said riser.

10. A subsea drilling/completion system of claim 5, wherein said protective structure serves as a manifold for directing individual control lines in said umbilical to said tubing hanger running tool.

11. A subsea drilling/completion system of claim 1, further comprising:

said tubing hanger running tool is controlled by hydraulic pressure communicated through an umbilical line extending alongside and outside said riser.

12. A subsea drilling/completion system of claim 1, further comprising:

said tubing hanger running tool is controlled by hydraulic pressure communicated through an umbilical line extending inside said landing string.

13. A subsea drilling/completion system as defined in claim 1, further comprising:

an annulus line extending through said subsea wellhead from above said tubing hanger to below said tubing hanger.

14. A subsea drilling/completion system of claim 13, further comprising:

a radial penetrator for passing flow from the annulus line to the tubing hanger.

15. A method of providing a subsea drilling/completion, comprising:

(a) providing a high-pressure riser extending between a platform and a subsea wellhead;

(b) providing a landing string extending inside the length of said riser;

(c) providing a surface blowout preventer disposed on said riser above the sea surface;

(d) providing a subsea blowout preventer below said sea surface substantially adjacent to said wellhead;

(e) using a retrievable tubing hanger running tool, running a tubing hanger through the riser and suspending tubing in said well below the subsea wellhead;

(f) controlling said tubing hanger running tool by hydraulic pressure; and (g) disengaging the tubing hanger running tool from the landed tubing hanger, and returning the tubing hanger running tool to the surface of the well.

16. A method of claim 15, wherein controlling said tubing hanger running tool by hydraulic pressure includes hydraulic pressure communicated inside said riser and outside said landing string.

17. The method of claim 15, wherein:

controlling said tubing hanger running tool by hydraulic pressure including hydraulic pressure communicated through said landing string.

18. A method of claim 15, wherein:

controlling said tubing hanger running tool by hydraulic pressure includes hydraulic pressure communicated through an umbilical line inside said landing string.

19. A method of claim 18, further comprising:

providing a protective structure protecting said umbilical line when said subsea blowout preventer is closed around said landing string.

20. A method of claim 19, wherein said protective structure comprises a ball drop activation sub.

21. A method of claim 19, wherein said protective structure radially within the subsea blowout preventer and radially outward of the umbilical line comprises a rupture disk actuation sub.

22. A method of claim 19, wherein said protective structure comprises a substantially annular structure surrounding said landing string and having a conduit extending along its length adapted to receive said umbilical therein.

23. A method of claim 22, further comprising a substantially annular sealing structure sealing said umbilical in said conduit.

24. A method of claim 19, wherein said protective structure serves as a manifold for directing individual control lines in said umbilical to said tubing hanger running tool.

25. A method of claim 15, wherein:

controlling said tubing hanger running tool by hydraulic pressure includes hydraulic pressure communicated through an umbilical extending alongside and outside said riser.

26. A method of claim 15, wherein:

controlling said tubing hanger running tool by hydraulic pressure includes hydraulic pressure communicated through an umbilical line extending inside said landing string.

27. A method of claim 26, further comprising:

providing a subsea blowout preventer disposed around said landing string below said sea surface substantially adjacent to said wellhead.

28. A method as defined in claim 15, further comprising:

extending an annulus line through said subsea wellhead from above said tubing hanger to below said tubing hanger.

29. A method of claim 28, further comprising:

passing flow from the annulus line through a radial penetrator and to the tubing hanger.

* * * * *